US011781760B2

(12) United States Patent
Mu et al.

(10) Patent No.: US 11,781,760 B2
(45) Date of Patent: Oct. 10, 2023

(54) INTEGRATED SPACE CONDITIONING AND WATER HEATING SYSTEMS AND METHODS THERETO

(71) Applicant: Rheem Manufacturing Company, Atlanta, GA (US)

(72) Inventors: Baojie Mu, Lewisville, TX (US); Sivakumar Gopalnarayanan, Plano, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 395 days.

(21) Appl. No.: 17/029,382

(22) Filed: Sep. 23, 2020

(65) Prior Publication Data

US 2022/0090803 A1 Mar. 24, 2022

(51) Int. Cl.

| | |
|---|---|
| ***F24F 5/00*** | (2006.01) |
| ***F24D 3/08*** | (2006.01) |
| ***F24H 4/04*** | (2006.01) |

(52) U.S. Cl.

CPC ..... *F24F 5/0096* (2013.01); *F24D 3/082* (2013.01); *F24H 4/04* (2013.01); *F24D 2220/06* (2013.01); *F24D 2220/08* (2013.01)

(58) Field of Classification Search

CPC ..... F24F 5/0096; F24F 11/67; F24F 2110/20; F24F 2221/18; F24D 3/082; F24D 2220/06; F24D 2220/08; F24H 4/04

(Continued)

(56) References Cited

U.S. PATENT DOCUMENTS

| | | | |
|---|---|---|---|
| 4,299,098 | A | 11/1981 | Derosier |
| 4,367,634 | A | 1/1983 | Bolton |

(Continued)

FOREIGN PATENT DOCUMENTS

| | | | |
|---|---|---|---|
| GB | 2537453 | A | 10/2016 |
| JP | H10288420 | A | 10/1998 |

(Continued)

OTHER PUBLICATIONS

International Search Report and Written Opinion for PCT Application No. PCT/US2021/040781 dated Oct. 14, 2021.

*Primary Examiner* — Steve S Tanenbaum

(74) *Attorney, Agent, or Firm* — Eversheds Sutherland (US) LLP

(57) ABSTRACT

The disclosed technology includes an integrated system including a space conditioning system, a liquid heating system, and a controller. The space conditioning system can include a refrigerant circuit fluidly connecting a compressor, a first heat exchanger, a second heat exchanger, a third heat exchanger, an expansion valve, and a reversing valve such that refrigerant can flow through the circuit. The liquid heating system can include a liquid heating device and a liquid circuit configured to direct liquid from the liquid heating device through the first heat exchanger. The controller can be in electrical communication with the space conditioning system and the liquid heating system. The controller can be configured to determine a demand of the space conditioning system and the liquid heating system, and in response, output instructions to a plurality of valves to direct the refrigerant through the refrigerant circuit and direct the liquid through the liquid circuit.

20 Claims, 10 Drawing Sheets

(58) Field of Classification Search
USPC ..... 62/56
See application file for complete search history.

(56) References Cited

U.S. PATENT DOCUMENTS

| | | | | |
|---|---|---|---|---|
| 5,036,676 | A | 8/1991 | Dudley | |
| 5,050,394 | A | 9/1991 | Dudley et al. | |
| 5,081,846 | A | 1/1992 | Dudley et al. | |
| 5,086,624 | A | 2/1992 | Matsuoka et al. | |
| 5,159,817 | A | 11/1992 | Hojo et al. | |
| 5,277,034 | A | 1/1994 | Hojo et al. | |
| 5,906,104 | A | 5/1999 | Schwartz et al. | |
| 9,003,818 | B2 | 4/2015 | Choi et al. | |
| 9,933,170 | B2 | 4/2018 | Wong | |
| 2007/0000274 | A1 | 1/2007 | Li | |
| 2011/0214437 | A1 | 9/2011 | Jeong et al. | |
| 2012/0042678 | A1 | 2/2012 | Park et al. | |
| 2013/0104574 | A1 | 5/2013 | Dempsey et al. | |
| 2013/0167559 | A1 | 7/2013 | Kim et al. | |
| 2013/0312443 | A1* | 11/2013 | Tamaki | F25B 13/00 62/228.1 |
| 2014/0116072 | A1 | 5/2014 | Kim et al. | |
| 2014/0174117 | A1* | 6/2014 | Aoyagi | F24D 19/1039 237/56 |
| 2014/0260392 | A1 | 9/2014 | Hawkins et al. | |
| 2015/0040841 | A1* | 2/2015 | Leman | F24D 19/1069 62/79 |
| 2016/0040895 | A1 | 2/2016 | Wong | |
| 2016/0131402 | A1 | 5/2016 | Kim et al. | |
| 2017/0086334 | A1 | 3/2017 | Riddle | |
| 2017/0234576 | A1* | 8/2017 | Kawagoe | F24H 15/38 62/203 |
| 2018/0051894 | A1 | 2/2018 | Yoshida et al. | |
| 2018/0120011 | A1 | 5/2018 | Goldman | |
| 2019/0063792 | A1 | 2/2019 | Kim et al. | |
| 2019/0309995 | A1* | 10/2019 | Chikami | F24F 5/0096 |
| 2020/0149785 | A1 | 5/2020 | Kojima | |
| 2020/0278138 | A1 | 9/2020 | Huang et al. | |

FOREIGN PATENT DOCUMENTS

| | | | |
|---|---|---|---|
| JP | 2017198414 | A | 11/2017 |
| WO | 2011015731 | A | 2/2011 |
| WO | 2019178117 | A1 | 9/2019 |

* cited by examiner

INTEGRATED SPACE CONDITIONING AND WATER HEATING SYSTEMS AND METHODS THERETO

FIELD OF THE DISCLOSURE

The present invention relates generally to an integrated space conditioning and water heating system, and more particularly to an integrated space conditioning and water heating system configured to operate in various modes to achieve an optimal or targeted system efficiency.

BACKGROUND

Residential and commercial building energy consumption can be significant. In order to reduce overall energy consumption, improvements to space conditioning systems and water heating systems have been explored. For example, heat pump water heaters can draw energy from ambient air surrounding the heat pump water heater through a vapor compression cycle to heat stored water. Although heat pump water heaters can be more energy efficient than traditional electric resistance water heaters, heat pump water heaters can have application and design challenges, including a need for greater space within a home or commercial building and an ability to provide sufficient air flow for an energy source. Further, the heat pump water heater can have reduced efficiency with increasing water temperature and/or decreasing ambient temperature.

In order to overcome some of the challenges presented by heat pump water heaters, some apparatus and methods have been used to combine the space conditioning system used to provide air-heating and air-cooling with the water heating system. By way of example, some existing systems can use rejected heat from a space conditioning system to pre-heat water. However, the overall energy savings of these existing systems can be dependent on significant hot water consumption, thereby limiting the application of these existing system to large and/or commercial structure. Additionally, current combined space conditioning and water heating systems can lack complete integration, and thus, an opportunity to further improve overall efficiency by complete integration of the space conditioning and water heating system exists.

SUMMARY

These and other problems can be addressed by the technologies described herein. Examples of the present disclosure relate generally to an integrated system including a space conditioning system and a liquid heating system configured to provide air-heating, air-cooling, and liquid-heating. The integrated system can include a controller in electrical communication with various components of the system such that the system can operate at a target efficiency.

The disclosed technology can include a system for conditioning air and heating water including a space conditioning system, a liquid heating system, and a controller. The space conditioning system can include a refrigerant circuit fluidly connecting a compressor, a first heat exchanger, a second heat exchanger, a third heat exchanger, an expansion valve, and a reversing valve. The refrigerant circuit can include conduit and a plurality of valves configured to direct refrigerant along the refrigerant circuit. The liquid heating system can include a liquid heating device and a liquid circuit fluidly connecting the liquid heating device and the first heat exchanger. The liquid circuit can include conduit configured to direct liquid along the liquid circuit and can be fluidly separate from the refrigerant circuit. The controller can be in electrical communication with the space conditioning system and the liquid heating system. The controller can be configured to determine a demand of the space conditioning system, determine a demand of the liquid heating system, and in response to determining the demand of the space conditioning system and the demand of the liquid heating system, output instructions to a plurality of valves to direct refrigerant through the refrigerant circuit and direct the liquid through the liquid circuit.

The system can further include a liquid temperature sensor configured to determine data indicative of a temperature of liquid within the liquid heating device; an indoor air temperature sensor configured to determine data indicative of a temperature of indoor air; an indoor air humidity sensor configured to determine data indicative of a humidity of indoor air; and an outdoor air temperature sensor configured to determine data indicative of a temperature of outdoor air.

The liquid circuit can further include a liquid pump in electrical communication with the controller and configured to activate and deactivate to selectively direct the liquid through the liquid flow path.

The liquid heating device can include a tank having a supplemental heating device. The supplemental heating device can be in electrical communication with the controller and can be configured to selectively activate and deactivate.

The liquid heating device can be a tankless water heater.

Each valve of the plurality of valves can be in electrical communication with the controller and can be configured to open and close to direct the refrigerant through the refrigerant circuit.

The system can be configured to operate in an air-cooling only mode and the plurality of valves can be configured to direct vapor refrigerant from the compressor to the second heat exchanger, the vapor refrigerant condensing into high-pressure liquid refrigerant; direct the high-pressure liquid refrigerant from the second heat exchanger to the expansion valve such that the high-pressure liquid refrigerant transitions into low-pressure liquid refrigerant; and direct the low-pressure liquid refrigerant from expansion valve to the third heat exchanger.

The system can be configured to operate in an air-cooling and liquid pre-heating mode and the plurality of valves is configured to direct vapor refrigerant from the compressor to the first heat exchanger to pre-heat the liquid flowing through the first heat exchanger, the vapor refrigerant condensing into high-pressure liquid refrigerant; direct the high-pressure liquid refrigerant from the first heat exchanger to the expansion valve such that the high-pressure liquid refrigerant transitions into low-pressure liquid refrigerant; and direct the low-pressure liquid refrigerant from expansion valve to the third heat exchanger.

The system can be configured to operate in an air-heating only mode and the plurality of valves is configured to direct vapor refrigerant from the compressor to the third heat exchanger, the vapor refrigerant condensing into high-pressure liquid refrigerant; direct the high-pressure liquid refrigerant from the third heat exchanger to the expansion valve such that the high-pressure liquid refrigerant transitions to low-pressure liquid refrigerant; and direct the low-pressure liquid refrigerant from the expansion valve to the second heat exchanger.

The system can be configured to operate in a liquid-heating only mode and the plurality of valves is configured to direct vapor refrigerant from the compressor to the first heat exchanger, the vapor refrigerant condensing into high-pressure liquid refrigerant; direct the high-pressure liquid refrigerant from the first heat exchanger to the expansion valve such that the high-pressure liquid refrigerant transitions to low-pressure liquid refrigerant; and direct the low-pressure liquid refrigerant from the expansion valve to the second heat exchanger.

The system can be configured to operate in an air-cooling and liquid-heating mode and the plurality of valves is configured to direct vapor refrigerant from the compressor to the first heat exchanger, the vapor refrigerant condensing into high-pressure liquid refrigerant; direct the high-pressure liquid refrigerant from the first heat exchanger to the expansion valve such that the high-pressure liquid refrigerant transitions to low-pressure liquid refrigerant; and direct the low-pressure liquid refrigerant from the expansion valve to the third heat exchanger.

The controller can be further configured to determine whether to activate a supplemental heating device disposed in a tank the liquid heating device or whether to enable at least one of the valves of the plurality of valves to direct the vapor refrigerant from the compressor and through the second heat exchanger.

The system can be configured to operate in an air-heating and liquid-heating mode, and the plurality of valves is configured to direct vapor refrigerant from the compressor to the first heat exchanger and the third heat exchanger, the vapor refrigerant condensing into high-pressure liquid refrigerant; direct the high-pressure liquid refrigerant from the first heat exchanger and the third heat exchanger to the expansion valve such that the high-pressure liquid refrigerant transitions to low-pressure liquid refrigerant; and direct the low-pressure liquid refrigerant from the expansion valve to the second heat exchanger.

The system can be configured to operate in a defrost mode, and the plurality of valves is configured to direct vapor refrigerant from the compressor to the second heat exchanger, the vapor refrigerant condensing into high-pressure liquid refrigerant; direct the high-pressure liquid refrigerant from the second heat exchanger to the expansion valve such that the high-pressure liquid refrigerant transitions to low-pressure liquid refrigerant; and direct the low-pressure liquid refrigerant from the expansion valve to the first heat exchanger.

The disclosed technology can also include non-transitory, computer readable medium storing instructions that, when executed by one or more processors, cause a controller of an integrated system including a space conditioning system and a liquid-heating system to receive, from an indoor air temperature sensor, indoor air temperature data indicative of a first temperature of indoor air, compare the indoor air temperature data to a threshold temperature of indoor air, and based on the comparison of the indoor air temperature data to the threshold temperature of indoor air, determine a first demand of the space conditioning system. The instructions can cause the controller to receive, from a water temperature sensor, water temperature data indicative of a first temperature of water, compare the water temperature data to a threshold temperature of water, and based on the comparison of the water temperature data to the threshold temperature of water, determine a first demand of the liquid heating system. Based at least in part on the first demand of the space conditioning system and the first demand of the liquid heating system, the instructions can further cause the controller to determine a first mode of operation of the integrated system. The instructions can further cause the controller to, in response to determining the first mode of operation, output instructions to a plurality of valves to direct refrigerant through the space conditioning system via a network of valves and direct liquid through the liquid heating system via a liquid pump.

Determining the first mode of operation of the integrated system can include determining an estimated time to meet the first demand of the space conditioning system and the first demand of the liquid heating system.

The threshold temperature of indoor air can be defined by a user.

The threshold temperature of water can be defined by a user.

Directing refrigerant through the space conditioning system can include opening and closing one or more valves of the network of valves and directing liquid through the liquid heating system can include activating and deactivating the liquid pump such that the integrated system operates at a target efficiency.

The instructions can further cause the controller to receive, from the indoor air temperature sensor, indoor air temperature data indicative of a second temperature of indoor air; compare the indoor air temperature data to the threshold temperature of indoor air; and based on the comparison of the indoor air temperature data to the threshold temperature of indoor air, determine a second demand of the space conditioning system. The instructions can cause the controller to receive, from the water temperature sensor, water temperature data indicative of a second temperature of water; compare the water temperature data to the threshold temperature of water; and based on the comparison of the water temperature data to the threshold temperature of water, determine a second demand of the liquid heating system. The instructions can cause the controller to, based at least in part on the first demand of the space conditioning system and the first demand of the liquid heating system, determine a second mode of operation of the integrated system; transition the integrated system from the first mode of operation to the second mode of operation; and output instructions to the plurality of valves to direct refrigerant through the space conditioning system via the network of valves and/or direct liquid through the liquid heating system via the liquid pump.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE FIGURES

Reference will now be made to the accompanying figures, which are not necessarily drawn to scale, and wherein.

DETAILED DESCRIPTION

Figure 1A:
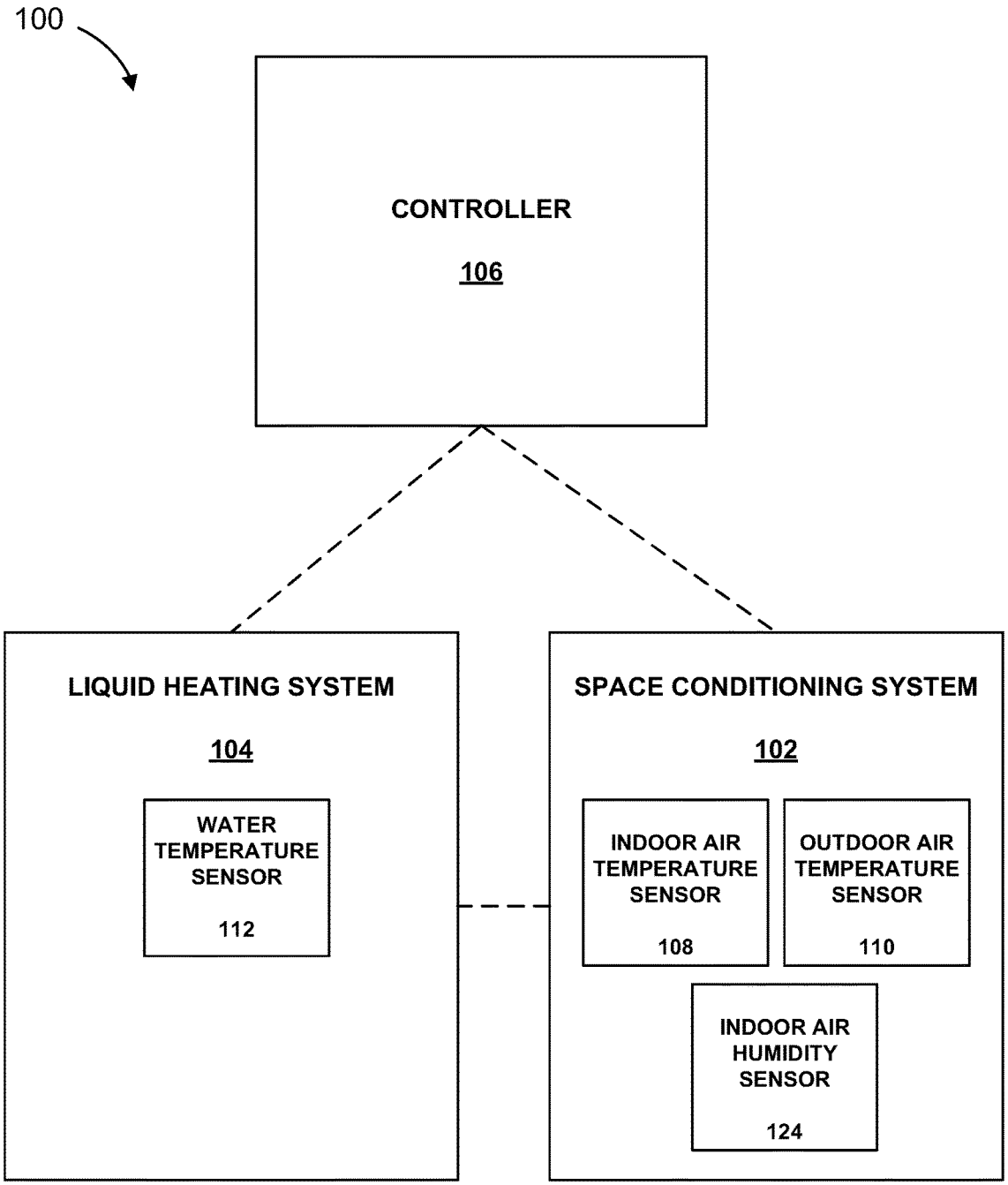
FIG. 1A is a schematic diagram illustrating an example system including a space conditioning system, a liquid heating system, and a controller, in accordance with the disclosed technology.

The disclosed technology relates to an integrated system, including a space conditioning system and a liquid heating system, configured to provide air-heating, air-cooling, and liquid-heating. The integrated system can include a controller in electrical communication with various components of the integrated system such that the integrated system can operate in a variety of modes depending on the demand of the space conditioning system and/or the demand of the liquid heating system to optimize or otherwise increase efficiency of the integrated system.

The disclosed technology will be described more fully hereinafter with reference to the accompanying drawings. This disclosed technology can, however, be embodied in many different forms and should not be construed as limited to the examples set forth herein. The components described hereinafter as making up various elements of the disclosed technology are intended to be illustrative and not restrictive. Such other components not described herein may include, but are not limited to, for example, components developed after development of the disclosed technology.

In the following description, numerous specific details are set forth. But it is to be understood that examples of the disclosed technology can be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

Unless otherwise specified, all ranges disclosed herein are inclusive of stated end points, as well as all intermediate values. By way of example, a range described as being "from approximately 2 to approximately 4" includes the values 2 and 4 and all intermediate values within the range. Likewise, the expression that a property "can be in a range from approximately 2 to approximately 4" (or "can be in a range from 2 to 4") means that the property can be approximately 2, can be approximately 4, or can be any value therebetween.

Referring now to the drawings, FIG. 1A illustrates a schematic diagram of an example system 100 including a space conditioning system 102, a liquid heating system 104, and a controller 106. The space conditioning system 102 can be configured to condition air within an interior area of a structure, including a building or house. By way of example, the space conditioning system 102 can provide an air-heating effect or an air-cooling effect depending on a demand of the space conditioning system 102. The air-cooling effect can reduce the temperature of the interior area and/or reduce humidity levels of the interior area. As used herein, the term "air-cooling" can refer to "air-conditioning" as known in the art. The liquid heating system 104 can be configured to provide a liquid-heating effect. By way of example, the liquid heating system 104 can provide heated water for domestic use. The space conditioning system 102 and the liquid heating system 104 can be integrated such that the system 100 can operate at an optimal or targeted efficiency (e.g., operating the liquid heating system 104 such that, even though the efficiency of the liquid heating system 104 may decrease, the efficiency of the space conditioning system 102 increases such that overall system efficiency becomes increased).

The space conditioning system 102 can include one or more sensors configured to determine an operative parameter of the indoor air and/or the outdoor air. The space conditioning system 102 can include one or more temperature sensors, including an indoor air temperature sensor 108 and an outdoor air temperature sensor 110. The indoor air temperature sensor 108 can be configured to determine a temperature of indoor air within the indoor space. The outdoor air temperature sensor 110 can be configured to determine a temperature of outdoor air. By way of example, the outdoor air temperature sensor 110 can determine the temperature of outdoor air of the building or house in which the space conditioning system 102 is located. Optionally, the space conditioning system 102 can further include one or more sensors configured to determine other operative parameters, including but not limited to, an indoor air humidity sensor 124 and/or a pressure sensor. The liquid heating system 104 can include a water temperature sensor 112 configured to determine a temperature of water within a tank of a liquid heating device 330 of the liquid heating system 104. The water temperature sensor 112 can be disposed within the tank. Alternatively or in addition to, the water temperature sensor 112 can be disposed proximate to an outlet pipe of the liquid heating device 330 such that the water temperature sensor 112 can determine a temperature of the water being outputted.

The space conditioning system 102 and the liquid heating system 104 can each be in electrical communication with the controller 106. The controller 106 can receive one or more signals from the indoor air temperature sensor 108, the outdoor air temperature sensor 110, and/or the water temperature sensor 112 indicating temperature data. The system 100 can include additional sensors configured to determine other operative parameters, and the controller 106 can receive one or more signals from such additional sensors. In response, the controller 106 can output one or more signals to various components of the space conditioning system 102 and the liquid heating system 104.

Figure 1B:
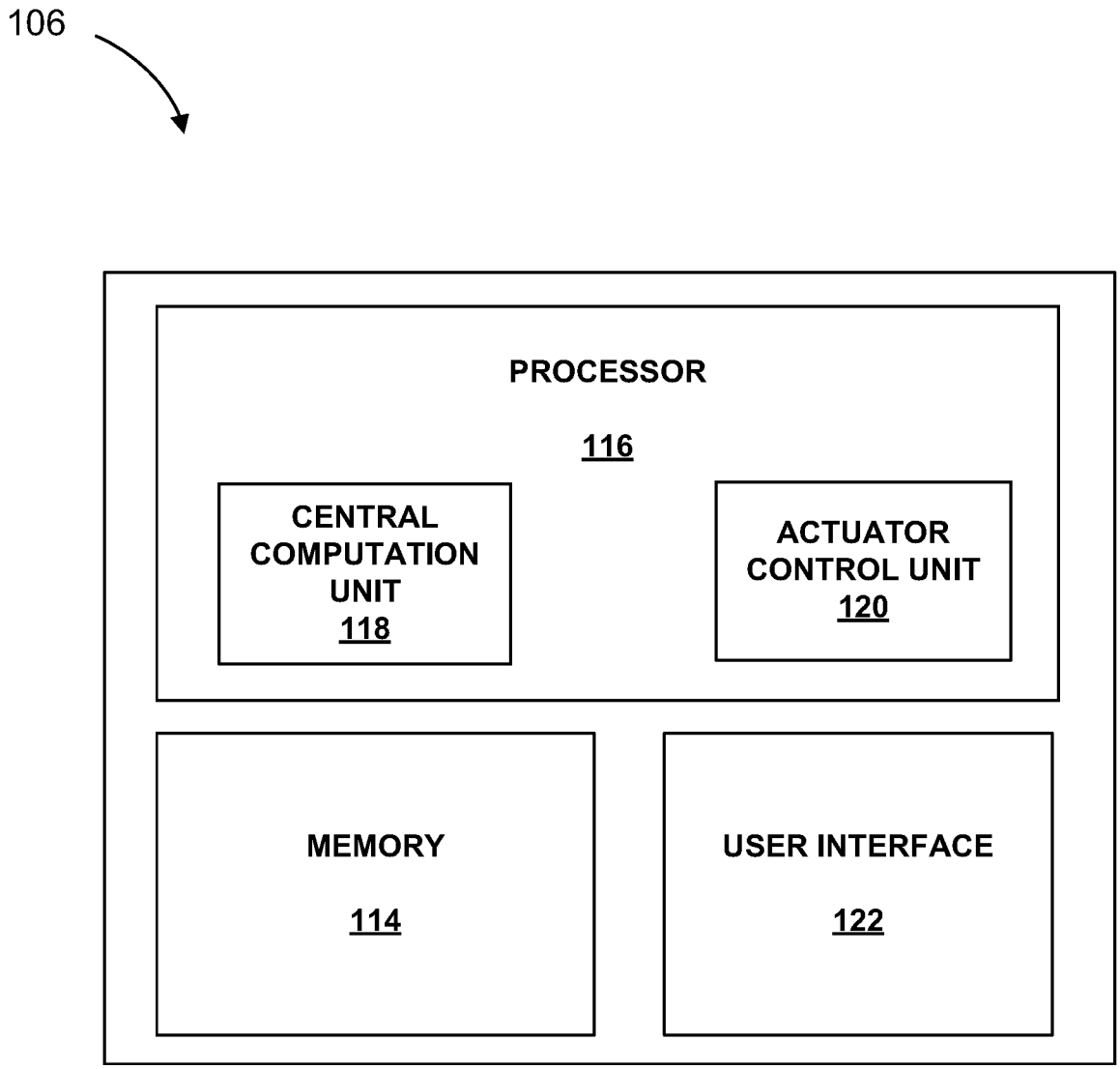
FIG. 1B is a schematic diagram of an example controller, in accordance with the disclosed technology.

FIG. 1B is a schematic diagram of an example controller 106. The controller 106 can be a computing device configured to receive data, determine actions based on the received data, and output a control signal instructing one or more components of the system to perform one or more actions. One of skill in the art will appreciate that the controller 106 can be installed in any location, provided the controller 106 is in communication with at least some of the components of the system 100. Furthermore, the controller 106 can be configured to send and receive wireless or wired signals and the signals can be analog or digital signals. The wireless signals can include Bluetooth™, BLE, WiFi™, ZigBee™, infrared, microwave radio, or any other type of wireless communication as may be appropriate for the particular application. The hard-wired signal can include any directly wired connection between the controller 106 and the other components. Alternatively, the components can be powered directly from a power source and receive control instructions from the controller 106 via a digital connection. The digital connection can include a connection such as an Ethernet or a serial connection and can utilize any appropriate communication protocol for the application such as Modbus, fieldbus, PROFIBUS, SafetyBus p, Ethernet/IP, or any other appropriate communication protocol for the application. Furthermore, the controller 106 can utilize a combination of wireless, hard-wired, and analog or digital communication signals to communicate with and control the various components. One of skill in the art will appreciate that the above configurations are given merely as non-limiting examples and the actual configuration can vary depending on the application.

The controller 106 can include a memory 114 that can store a program and/or instructions associated with the functions and methods described herein and can include a processor 116 configured to execute the program and/or instructions. The memory 114 can include one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like) for storing files including the operating system, application programs (including, for example, a web browser application, a widget or gadget engine, and or other applications, as necessary), executable instructions and data. One, some, or all of the processing techniques or methods described herein can be implemented as a combination of executable instructions and data within the memory.

The processor 116 can include a central computation unit 118 and/or an actuator control unit 120 configured to control various components of the system 100. The central computation unit 118 and the actuator control unit 120 can control various components and/or operation of the system 100 based at least in part on the temperature data from the indoor air temperature sensor 108, the outdoor air temperature sensor 110, the water temperature sensor 112, and any other additional sensors.

Additionally, the controller 106 can have or be in communication with a user interface 122 for displaying information pertaining to the system 100 and receiving inputs from a user. The user interface 122 can be installed locally on the system 100 or be a remotely-control device such as a mobile device. The user, for example, can input data pertaining to a set indoor air temperature and/or upper and lower threshold indoor air temperatures. The lower threshold indoor air temperature can be any predetermined amount less than the set temperature to indicate a demand for air-heating. The upper threshold indoor air temperature can be any predetermined amount greater than the set temperature to indicate a demand for air-cooling. By way of example, the set indoor air temperature can be approximately 25° C., the lower threshold indoor air temperature can be approximately 20° C. to indicate demand for air-heating, and the upper threshold indoor air temperature can be approximately 30° C. to indicate a demand for air-cooling. Alternatively, or in addition to, the user can input data pertaining to a set humidity level of indoor air and/or upper and lower humidity threshold levels of indoor air. Alternatively, or in addition to, the user can input data pertaining to a set water temperature and/or a threshold water temperature. By way of example, the set water temperature can be approximately 60° C., and the threshold water temperature can be approximately 40° C. to indicate a demand for liquid-heating.

The controller 106 can optionally include an artificial intelligence (AI) module. The AI module can include one or more AI chips that can support a system on a chip (SoC) with AI models and algorithms. The AI module can be configured to automatically learn from patterns and trends pertaining to operation of the system 100 and/or the user inputted data such that the system 100 can optimize or otherwise increase efficiency. By way of example, the AI module can be configured to automatically learn over a period of time the temperature settings inputted by the user, the demand profile for cooling and heating of air and water, and/or the local climate conditions where the system 100 is installed (e.g., based on data detected by one or more sensors included in the system 100 or otherwise in communication with the AI module, based on environmental data received by the AI module). The AI module can use such information to optimize the system 100 to perform efficiently. For example, if a user uses heated water every morning at approximately 6 a.m., the AI module can recognize this demand pattern and subsequently can learn to begin operating the system 100 to provide heated water at approximately 6 a.m. without waiting for the temperature of water to reach the set water temperature.

Figure 2:
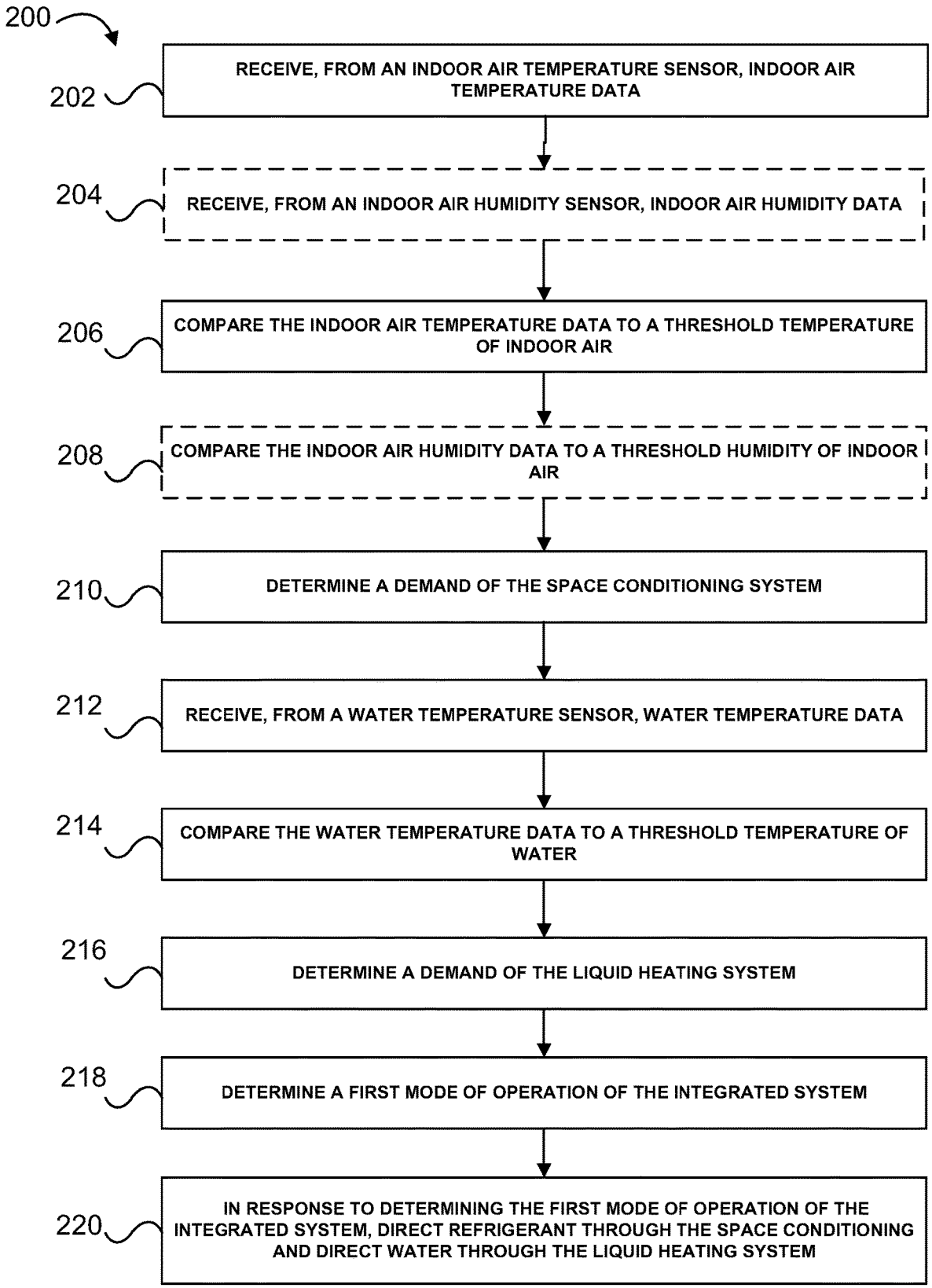
FIG. 2 is a flow chart outlining an example method of providing space conditioning and liquid-heating using the example system of FIG. 1A, in accordance with the disclosed technology.

FIG. 2 is a flow diagram outlining an example method 200 of providing space conditioning and liquid heating using the system 100. A non-transitory, computer readable medium can store instructions that, when executed by one or more processors 116, can cause the controller 106 to execute the method 200 (or any other method in accordance with the disclosed technology). The method 200 can include receiving 202 (e.g., from the indoor air temperature sensor 108) indoor air temperature data indicative of a temperature of the indoor air in the indoor space. Alternatively, or in addition to, the method 200 can include receiving 204 (e.g., from the indoor air temperature sensor 108) indoor air temperature data indicative of a humidity level of the indoor air in the indoor space. Based on data (e.g., user inputted data) indicating the set temperature and/or the upper and lower threshold indoor air temperatures, the method 200 can include can comparing 206 the indoor air temperature data to the set temperature and/or the upper and lower threshold indoor air temperatures. Alternatively, or in addition to, the method 200 can include comparing 208 the indoor air humidity data to the set humidity level and/or the upper and lower threshold humidity levels. Based on the comparison(s) 204, 206, the method 200 can include determining 210 the demand of the space conditioning system. By way of example, the method 200 can include determining there is a demand for air-heating when the comparison indicates the temperature of the indoor air is less than the set temperature and/or equal to or less than the lower threshold temperature and can include determining there is a demand for air-cooling when the temperature is greater than the set temperature and/or equal to or greater than the upper threshold temperature. The method 200 can include determining there is no demand for air-heating or air-cooling when the temperature data indicates the temperature of the indoor air is approximately equal to the set temperature.

The method 200 can include receiving 212 (e.g., from the water temperature sensor 112) water temperature data indicative of a temperature of water within the tank of the liquid heating device 330 of the liquid heating system 104. Based on data (e.g., user inputted data) regarding the set water temperature and/or the threshold water temperature, the method 200 can include comparing 214 the water temperature data with the set water temperature and/or the threshold water temperature to determine 216 the demand of the liquid heating system. When the water temperature data indicates the temperature of the water is less than the set water temperature and/or equal to or less than the threshold water temperature, the method 200 can include determining there is a demand for liquid-heating. The method 200 can include determining there is no demand for liquid-heating when the temperature data indicates the temperature of the water is approximately the set temperature.

The method 200 can include determining 218 a mode of operation of the system 100 based at least in part on the determined demand of the space conditioning system 102 and the determined demand of the liquid heating system 104. By way of example, the central computation unit 118 of the controller 106 can determine the mode of operation of the system 100. Optionally, the mode of operation can be determined based on additional operative parameters, including but not limited to, temperature data from the outdoor air temperature sensor, an estimated amount of time for the space conditioning system 102 and/or the liquid heating system 104 to meet the determined demand, and inputted data pertaining to user preference regarding operation of the system 100. By way of example, the system 100 can operate in at least five different modes of operation, including air-cooling mode, simultaneous air-cooling and liquid-heating mode, air-heating mode, simultaneous air-heating and liquid-heating mode, and liquid-heating mode. The controller 106 can remain in continuous electrical communication with the system 100 over a predetermined amount of time in order to provide dynamic control of the system 100. Accordingly, the system 100 can transition between modes of operation when the demand of the system 100 changes (e.g., the controller 106 determines the space conditioning system is indicating a second demand and/or the liquid heating system is indicating a second demand) or upon a change in inputted data by a user.

In response to determining the mode of operation of the system 100, the method 200 can include directing 220 refrigerant through the space conditioning system 102 and water through the liquid heating system 104 in order to achieve a highest balanced efficiency. By way of example, the controller 106 can send signals to a plurality of valves to open and/or close to direct refrigerant through the space conditioning system 102 such that the demand of the space conditioning system 102 and the liquid heating system 104 can be met. The controller 106 can further determine an appropriate amount of refrigerant to direct through the refrigerant circuit 314 such that the system 100 can operate at an overall target efficiency.

The method can include selectively activating and/or deactivating one or more components of the space conditioning system 102 and/or the liquid heating system 104 based on the determined mode of operation in order to achieve an increased (e.g., an optimized) efficiency of the system 100. The optimized system efficiency or highest balanced efficiency of the system 100 can be represented as a coefficient of performance, energy efficiency ratio, or any other efficiency metric.

Efficiency of the system 100 can be based on the highest balanced efficiency of the overall system 100, which includes the space conditioning system 102 and the liquid heating system 104. By way of example, the method 200 can include determining that the system 100 can operate at an overall target efficiency (i.e., system-level efficiency) by operating the space conditioning system 102 at a sub-system efficiency that is less than the target or optimal efficiency of the space conditioning system 102 itself, in order to operate the liquid heating system 104 at an increased efficiency that, in turn, offsets the efficiency decrease experienced by the space conditioning system 102 and increases the overall efficiency of the system 100. Alternatively, the method 200 can include determining the system 100 can operate at an overall target efficiency by operating the liquid heating system 104 at a sub-system efficiency that is less than the target or optimal efficiency of the liquid heating system 104 itself, in order to operate the space conditioning system 102 at an increased efficiency that, in turn, offsets the efficiency decrease experienced by the liquid heating system 104 and increases the overall efficiency of the system 100. The target efficiency of the system 100 can be an optimal efficiency (e.g., as calculated by the controller 106) of the system 100. The concept of operate one sub-system at a decreased or sub-target efficiency in order to operate the other sub-system at an increased efficiency such that the system 100 can achieve the highest balanced efficiency is discussed in further detail herein. In particular, FIGS. 3A-3G illustrate the implementation of such control methods to operate the system 100 in various modes to achieve the overall target efficiency of the system 100.

FIGS. 3A-3G are schematic diagrams of the system 100 being configured to operate in the various modes of operation. The space conditioning system 102 can include a compressor 302, a reversing valve 304 (e.g., a four-way reversing valve), an expansion valve 306 (e.g., a bi-directional expansion valve), a water-cooled heat exchanger 308, an outdoor heat exchanger 310, and an indoor heat exchanger 312. The compressor 302 can be a variable speed compressor (i.e., an inverter driven compressor) or a multi-speed compressor. For example, the compressor 302 can operate at a higher speed in order to meet a demand of the space conditioning system 102 and/or water heating system 104. Additionally, in order to achieve a target efficiency, the compressor 302 can operate at a higher speed in order to first meet a demand of the space conditioning system 102 (i.e., lower the temperature of indoor air to a set temperature) relatively quickly and then subsequently reduce the speed of the compressor 302 to meet a demand of the liquid heating system 104. A refrigerant circuit 314 can be configured to direct refrigerant through each of these components of the space conditioning system 102 based on the determined mode of operation. The refrigerant circuit 314 can include one or more conduits (e.g., tubing, piping, or the like) configured to direct vapor refrigerant and liquid refrigerant through the refrigerant circuit 314.

The refrigerant circuit 314 can include a plurality of valves in electrical communication with the controller 106. The plurality of valves can be configured to direct vapor refrigerant and liquid refrigerant and/or adjust the amount of vapor refrigerant and liquid refrigerant through the space conditioning system 102 based on instructions from the controller 106. As illustrated in FIGS. 3A-3G, the refrigerant circuit 314 can include eight valves. In particular, the actuator control unit 120 can receive instructions from the central computation unit 118 pertaining to the opening and closing of the valves in order to selectively direct refrigerant through the refrigerant circuit 314 and thereby through the various components of the space conditioning system 102 depending on the mode of operation.

The refrigerant circuit 314 can further include a first bypass pipe 326 and a second bypass pipe 328. The first bypass pipe 326 can direct refrigerant between a seventh valve 344 and a first valve 316 when operating in a particular mode. The second bypass pipe 328 can direct refrigerant from the compressor 302 directly to the outdoor heat exchanger 310 via the reversing valve 304, the eighth valve 346, and the second valve 318. Similarly, the second bypass pipe 328 can direct refrigerant from the outdoor heat exchanger 310 directly to the compressor 302 via the second valve 318, the eighth valve 346, and the reversing valve 304.

The liquid heating system 104 can include a liquid heating device 330 having a storage tank. The tank can be of any size, including but not limited to 5 gallons, 10 gallons, and 20 gallons. The liquid heating device 330 can include a heating device 336. The heating device 336 can be an electrical heating device. Alternatively, the heating device 336 can be a gas heating device, including a gas burner. The heating device 336 can be in electrical communication with the controller 106, such that the heating device 336 can be activated upon a demand for heated water. The liquid heating device 330 can include an inlet 332 for receiving unheated water from a water supply line. The liquid heating device 330 can include an outlet 334 for outputting heated water for domestic use. Although FIGS. 3A-3G illustrate the liquid heating system 104 including a tank-based liquid heating device 330, it is contemplated the liquid heating system 104 can include a tankless or point-of-use liquid heating device.

The liquid heating system 104 can include a water circuit 338 having a water circulating pump 340. The water circuit 338 can be in thermal communication with the water-cooled heat exchanger 308, thereby integrating the liquid heating system 104 and the space conditioning system 102.

Figure 3A:
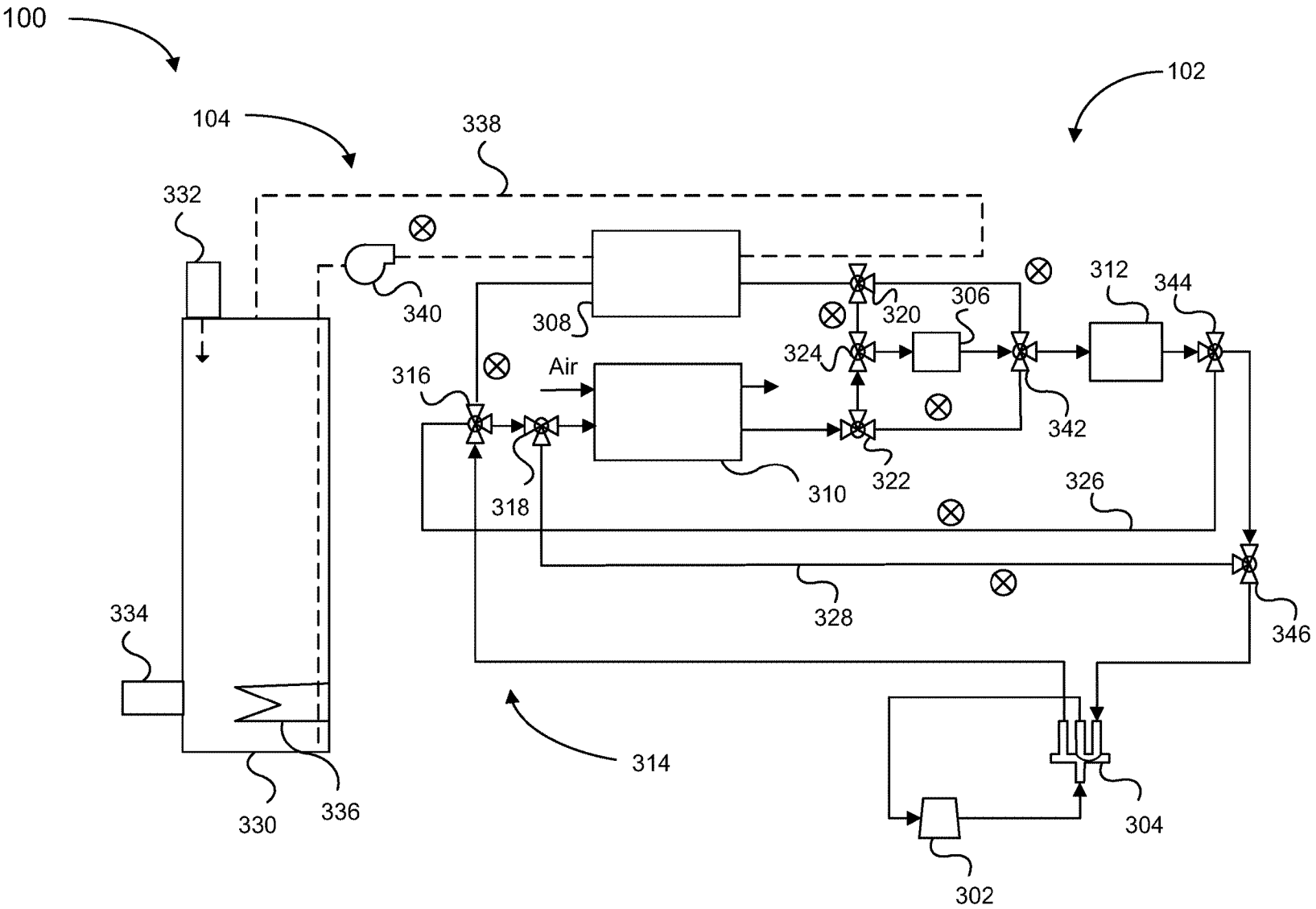
FIG. 3A is a schematic diagram of the example system of FIG. 1A configured to operate in an air-cooling mode, in accordance with the disclosed technology.

FIG. 3A is a schematic diagram of the system 100 configured to operate in an air-cooling only mode of operation. Based on temperature data received from the indoor air temperature sensor 108 and the water temperature sensor 112 and/or the humidity data received from the indoor air humidity sensor 124, the controller 106 can determine there is a demand for air-cooling and no demand for liquid-heating. In response, the controller 106 can send one or more signals to various components of the space conditioning system 102 and the liquid heating system 104 to configure the system 100 to meet the air-cooling demand while operating at a target efficiency.

The controller 106 can send a signal to the water circulating pump 340 to deactivate. The controller 106 can send a signal to the reversing valve 304 to operate in the air-cooling mode. Additionally, the controller 106 can send signals to the plurality of valves to open and/or close in order to appropriately direct refrigerant through the desired refrigerant circuit 314 as described herein such that the water-cooled heat exchanger is deactivated by way of not receiving refrigerant and the outdoor heat exchanger and the indoor heat exchanger are both activated by way of receiving refrigerant.

In this configuration, the water circulating pump is not activated such that water is not directed through the liquid circuit 338, and accordingly, no water is pre-heated via the water-cooled heat exchanger 308. If controller 106 determines the temperature of water drops below the set temperature and/or the threshold temperature during operation of the air-cooling only mode, the controller 106 can activate the heating device 336 to maintain the temperature of the water at approximately the set water temperature. Alternatively, the controller 106 can operate the system 100 in a heat recovery mode described in FIG. 3B. The first valve 316 and the second valve 318 can be configured to direct high-pressure vapor refrigerant from the compressor 302 and to the outdoor heat exchanger 310, which in this configuration is operating as a condenser, thereby condensing the high-pressure vapor refrigerant into high-pressure liquid refrigerant. The first valve 316 and the third valve 320 can be configured to prevent the high-pressure vapor refrigerant from being directed from the compressor 302 to the water-cooled heat exchanger 308, as water is not being directed through the water circuit 338 and there is no demand for liquid-heating. The second valve 318 and the eighth valve 346 can be configured to prevent the high-pressure vapor refrigerant from being directed through the second bypass pipe 328. Upon passing through the outdoor heat exchanger 310, the fourth valve 322 and the fifth valve 324 can be configured to direct the high-pressure liquid refrigerant to the expansion valve 306. The expansion valve 306 can transition the high-pressure liquid refrigerant to low-pressure liquid or two-phase refrigerant. The liquid or two-phase refrigerant can be directed to the indoor heat exchanger 312 via the sixth valve 342. In this configuration the indoor heat exchanger 312 is operating as an evaporator, thereby heating the liquid refrigerant and transitioning the low-pressure liquid or two-phase refrigerant into low-pressure vapor refrigerant. Accordingly, the indoor heat exchanger 312 can provide the air-cooling effect to the indoor area as the low-pressure liquid or two-phase refrigerant can absorb heat from the indoor ambient air passing over the indoor heat exchanger 312. The sixth valve 342 can be configured to prevent the low-pressure liquid or two-phase refrigerant from being directed back to the fourth valve 322 such that low-pressure liquid or two-phase refrigerant is not directed back to the outdoor heat exchanger 310. The seventh valve 344 can be configured to prevent the low-pressure vapor refrigerant from being directed to the first valve 316 via the first bypass pipe 326. The low-pressure vapor refrigerant can be directed back to the compressor 302 via the seventh valve 344, the eighth valve 346, and the reversing valve 304 such that the cycle can repeat.

Figure 3B:
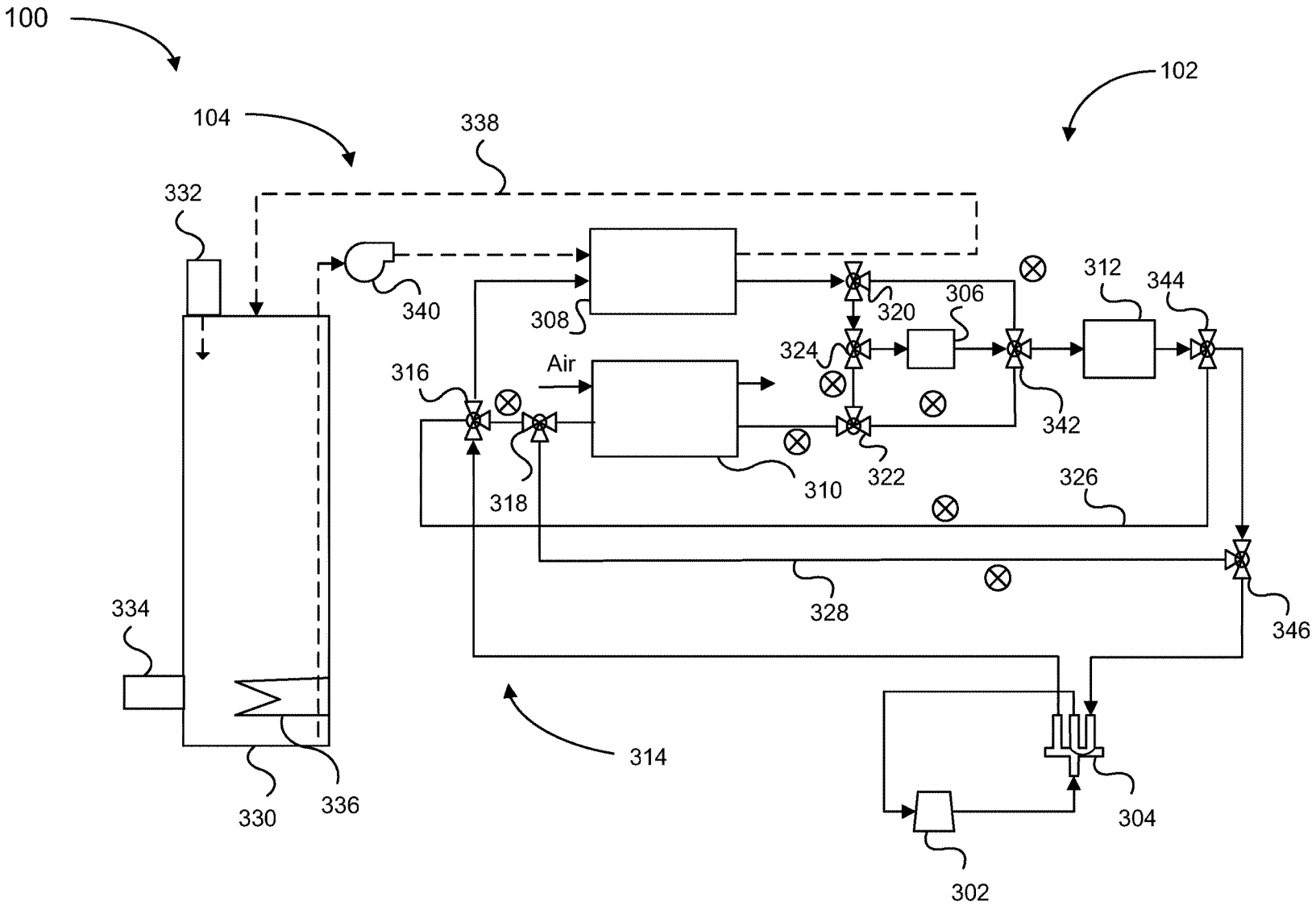
FIG. 3B is a schematic diagram of the example system of FIG. 1A configured to operate in an air-cooling and heat recovery mode, in accordance with the disclosed technology.

FIG. 3B is a schematic diagram of the system 100 configured to operate in an air-cooling and heat recovery mode of operation. Based on temperature data received from the indoor air temperature sensor 108 and/or the humidity data received from the indoor air humidity sensor 124, the controller 106 can determine there is a demand for air-cooling and no demand for liquid-heating. Based on temperature data received from the water temperature sensor 112, the controller 106 can determine that the temperature of water within the tank of the liquid heating device 330 is below the set water temperature but above the threshold temperature required to initiate heat pump water heating or supplemental water heating via the heating device 336. When the controller 106 receives such signals from the water temperature sensor 112, the controller 106 can determine the system 100 can operate in a heat recovery mode in order to achieve the target efficiency.

The controller 106 can send a signal to the water circulating pump 340 to activate. The controller 106 can send a signal to the reversing valve 304 to operate in an air-cooling mode. The controller 106 can send signals to the plurality of valves to open and/or close in order to appropriately direct refrigerant through the refrigerant circuit 314 as described herein such that the outdoor heat exchanger 310 is deactivated by way of not receiving refrigerant and the water-cooled heat exchanger 308 and the indoor heat exchanger 312 are activated by way of receiving refrigerant.

In this configuration, the first valve 316 can be configured to direct high-pressure vapor refrigerant from the compressor 302 to the water-cooled heat exchanger 308, which in this configuration is operating as a condenser, thereby condensing the high-pressure vapor refrigerant into high-pressure liquid refrigerant. The first valve 316 and the second valve 318 can be configured to prevent the high-pressure vapor refrigerant from being directed from the compressor 302 to the outdoor heat exchanger 310. Water can simultaneously be directed from the liquid heating device 330 through the water-cooled heat exchanger 308 via the water circulating pump 340. The high-pressure vapor refrigerant flowing through the water-cooled heat exchanger 308 can be warmer than the water passing through the water-cooled heat exchanger 308. Heat energy rejected from the high-pressure vapor refrigerant can be transferred to the cooler water, thereby efficiently preheating the water flowing through the water circuit 338 and returning to the tank. When the water flowing through the water circuit 338 is heated via the water-cooled heat exchanger 308, the temperature of water in the tank can reach the set temperature. The third valve 320 and the fifth valve 324 can be configured to direct the high-pressure liquid refrigerant from the water-cooled heat exchanger 308 to the expansion valve 306. The expansion valve 306 can transition the high-pressure liquid refrigerant to low-pressure liquid or two-phase refrigerant. The sixth valve 342 can prevent the low-pressure liquid or two-phase refrigerant from being directed back to the fourth valve 322 and/or back to the outdoor heat exchanger 310. The sixth valve 342 can be configured to direct the low-pressure liquid or two-phase refrigerant to the indoor heat exchanger 312, which in this configuration is operating as an evaporator, thereby providing an air-cooling effect to the indoor area as the low-pressure liquid or two-phase refrigerant absorbs heat from the indoor ambient air and becomes vapor. The low-pressure vapor refrigerant can be directed back to the compressor 302 via the seventh valve 344, the eighth valve 346, and the reversing valve 304. The eighth valve 346 can be configured to prevent the low-pressure vapor refrigerant from being directed through the second bypass pipe 328 and back to the second valve 318, thereby preventing refrigerant from being directed to the outdoor heat exchanger 310. The cycle can then repeat to continue to provide air-cooling and heat recovery.

The air-cooling and heat recovery mode of operation can be particularly applicable when the outdoor temperature is relatively high. When the outdoor temperature is relatively high, it can be more efficient to cool the high-pressure vapor refrigerant flowing through the water-cooled heat exchanger 308 via warm water flowing through the water circuit 338 than to cool the high-pressure vapor refrigerant using the warm outdoor air via the outdoor heat exchanger 310. Accordingly, the system 100 can be configured such that high-pressure vapor refrigerant can be directed only to the water-cooled heat exchanger 308, as illustrated in FIG. 3B.

Figure 3C:
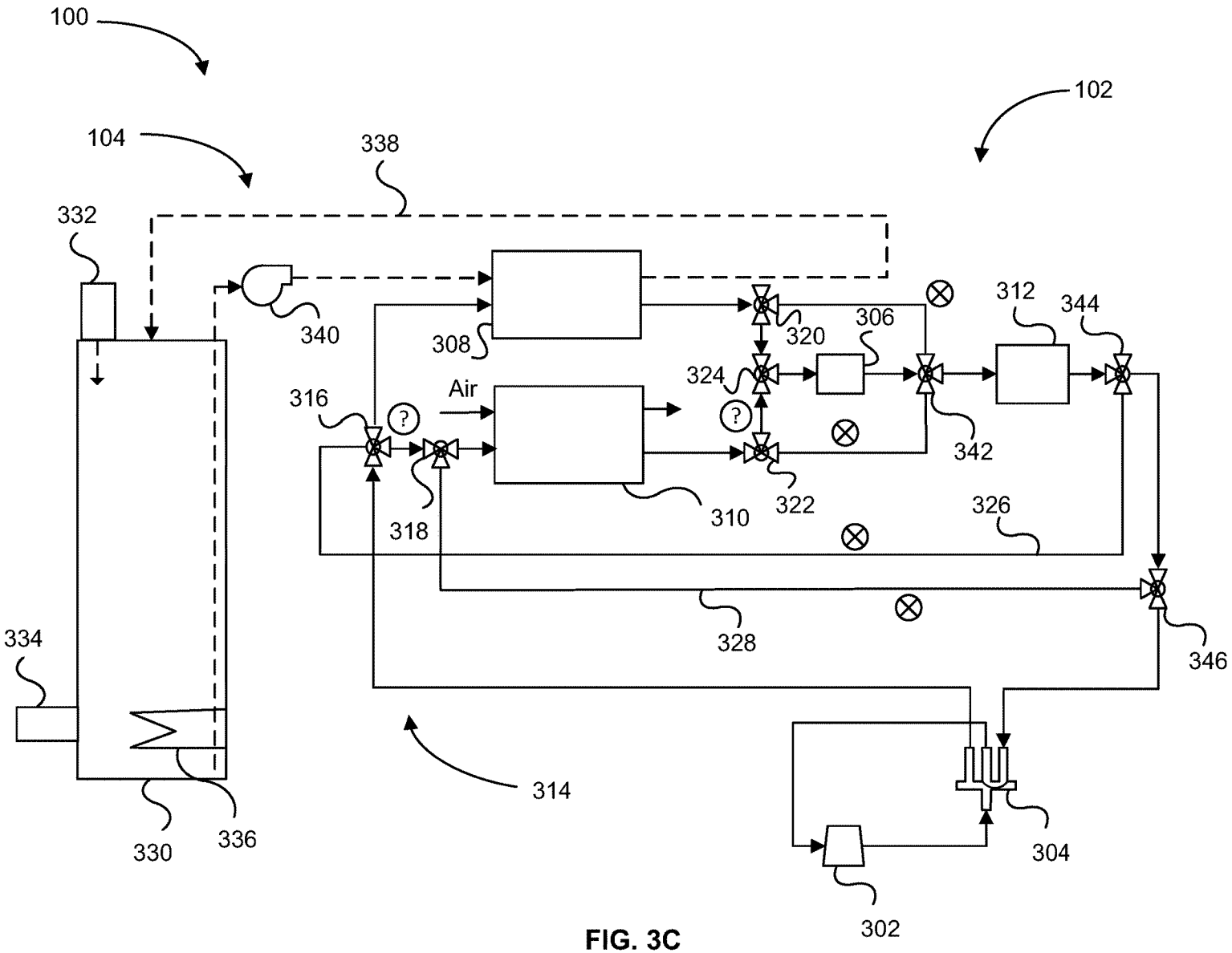
FIG. 3C is a schematic diagram of the example system of FIG. 1A configured to operate in an air-cooling and a liquid-heating mode, in accordance with the disclosed technology.

FIG. 3C is a schematic diagram of the system 100 configured to operate in an air-cooling and liquid-heating mode of operation. Based on temperature data received from the indoor air temperature sensor 108 and the water temperature sensor 112 and/or humidity data received from the indoor air humidity sensor 124, the controller 106 can determine there is a demand for air-cooling and a demand for liquid-heating. In response, the controller 106 can send one or more signals to various components of the space conditioning system 102 and the liquid heating system 104 to configure the system 100 to meet the air-cooling and liquid-heating demand while operating at the target efficiency.

The controller 106 can send a signal to the water circulating pump 340 to activate. The controller 106 can send a signal to the reversing valve 304 to operate in an air-cooling mode. The controller 106 can send signals to the plurality of valves to open and/or close in order to appropriately direct refrigerant through the refrigerant circuit 314 as described herein such that the water-cooled heat exchanger 308, the outdoor heat exchanger 310, and the indoor heat exchanger 312 are activated by way of receiving refrigerant.

The central computation unit 118 of the controller 106 can determine whether to direct refrigerant through the outdoor heat exchanger 310, water cooled heat exchanger 308 and/or activate the heating device 336 within the tank of the liquid heating device 330 based at least in part on the temperature of water in the tank as determined by the water temperature sensor 112, the temperature of indoor air as determined by the indoor air temperature sensor 108, the humidity of indoor air as determined by the indoor air humidity sensor 124, and/or the temperature of outdoor air as determined by the outdoor air temperature sensor 110 such that the system 100 can operate at the target efficiency. As illustrated in FIG. 3C, the "?" indicates the controller 106 making such determination. In response, the actuator control unit 120 can output instructions to the plurality of valves such that the valves are configured to direct refrigerant accordingly.

In this configuration, the first valve 316 can be configured to direct high-pressure vapor refrigerant from the compressor 302 to the water-cooled heat exchanger 308, which in this configuration is operating as a condenser, thereby condensing the high-pressure vapor refrigerant into high-pressure liquid refrigerant. Water can be simultaneously directed from the tank of the liquid heating device 330 through the water-cooled heat exchanger 308 via the water circulating pump 340. The high-pressure vapor refrigerant can be warmer than the water passing through the water-cooled heat exchanger 308. Heat energy rejected from the high-pressure vapor refrigerant can be transferred to the cooler water, thereby heating the water flowing through the water circuit 338 and returning to the tank. After passing through the water-cooled heat exchanger 308, the third valve 320 and the fifth valve 324 can be configured to direct the high-pressure liquid refrigerant to the expansion valve 306. The expansion valve 306 can transition the high-pressure liquid refrigerant to low-pressure liquid or two-phase refrigerant. The sixth valve 342 can be configured to direct the low-pressure liquid or two-phase refrigerant to the indoor heat exchanger 312, which in this configuration is operating as an evaporator, thereby providing an air-cooling effect to the indoor area. The low-pressure liquid or two-phase refrigerant can become low-pressure vapor refrigerant as the low-pressure liquid or two-phase refrigerant passes through the indoor heat exchanger 312. The seventh valve 344 can be configured to prevent the low-pressure vapor refrigerant from being directed through the first bypass pipe 326 and back to the first valve 316. The low-pressure vapor refrigerant can be directed back to the compressor 302 via the seventh valve 344, the eighth valve 346, and the reversing valve 304 such that the cycle can repeat. The eighth valve 346 can be configured to prevent the low-pressure vapor refrigerant from being directed through the second bypass pipe 328 and back to the second valve 318 such that refrigerant does not pass through the outdoor heat exchanger 310.

If the central computation unit 118 of the controller 106 determines the system 100 will achieve the target efficiency by directing hot vapor refrigerant through the outdoor heat exchanger 310 and activating the heating device 336 to provide water heating instead of directing the vapor refrigerant through the water cooled heat exchanger 308, the first valve 316 and the second valve 318 can be configured to direct a majority of the vapor refrigerant from the compressor 302 to the outdoor heat exchanger 310, which in this configuration is operating as a condenser, thereby condensing the vapor refrigerant into high-pressure liquid. After passing through the outdoor heat exchanger 310, the fourth valve 322 and the fifth valve 324 can be configured to direct the high-pressure liquid refrigerant to the expansion valve 306. The expansion valve 306 can transition the high-pressure liquid refrigerant to low-pressure liquid or two-phase refrigerant. The sixth valve 342 can be configured to direct the low-pressure liquid or two-phase refrigerant to the indoor heat exchanger 312, thereby providing the air-cooling effect to the indoor area. The low-pressure liquid or two-phase refrigerant can transition into low-pressure vapor refrigerant as the low-pressure liquid or two-phase refrigerant passes through the indoor heat exchanger. The low-pressure vapor refrigerant can be directed back to the compressor 302 via the seventh valve 344, the eighth valve 346, and the reversing valve 304 such that the cycle can repeat. By way of example, if the outdoor air temperature is relatively low and if the temperature of water relatively high, but still below the set temperature, the controller 106 can determine the water-cooled heat exchanger 308 can sufficiently heat the water to approximately the set temperature, and therefore, the system 100 can achieve the target efficiency by activating configuring the first valve 316 and the second valve 318 to direct a majority of the vapor refrigerant through outdoor heat exchanger 310, thereby providing a high throughput of refrigerant passing through the indoor heat exchanger 312, resulting in efficient air-cooling.

Alternatively, if the central computation unit 118 of the controller 106 determines the system 100 will achieve the target efficiency by directing high-pressure vapor refrigerant through the water cooled heat exchanger 308, the first valve 316, the second valve 318, and the fourth valve 322 can be configured to prevent high-pressure vapor refrigerant from being directed through the outdoor heat exchanger 310. Alternatively, the first valve 316 and second valve 318 can be configured to allow a predetermined amount of high-pressure vapor refrigerant to be directed through the outdoor heat exchanger 310 and water-cooled heat exchanger 308. Additionally, the heating device 336 within the tank can be activated, such that the water within the tank can be heated to the set water temperature. The controller 106 can determine an appropriate amount of power to supply the heating device 336 such that the system 100 operates at a target efficiency. Once the temperature of water reaches the set temperature, the controller 106 can send signals to the first valve 316 to direct a minimal amount (e.g., a decreased amount) of refrigerant to the water-cooled heat exchanger 308 to maintain the water at the set temperature. The controller 106 can further send a signal to the heating device 336 to deactivate upon the water reaching the set temperature.

Figure 3D:
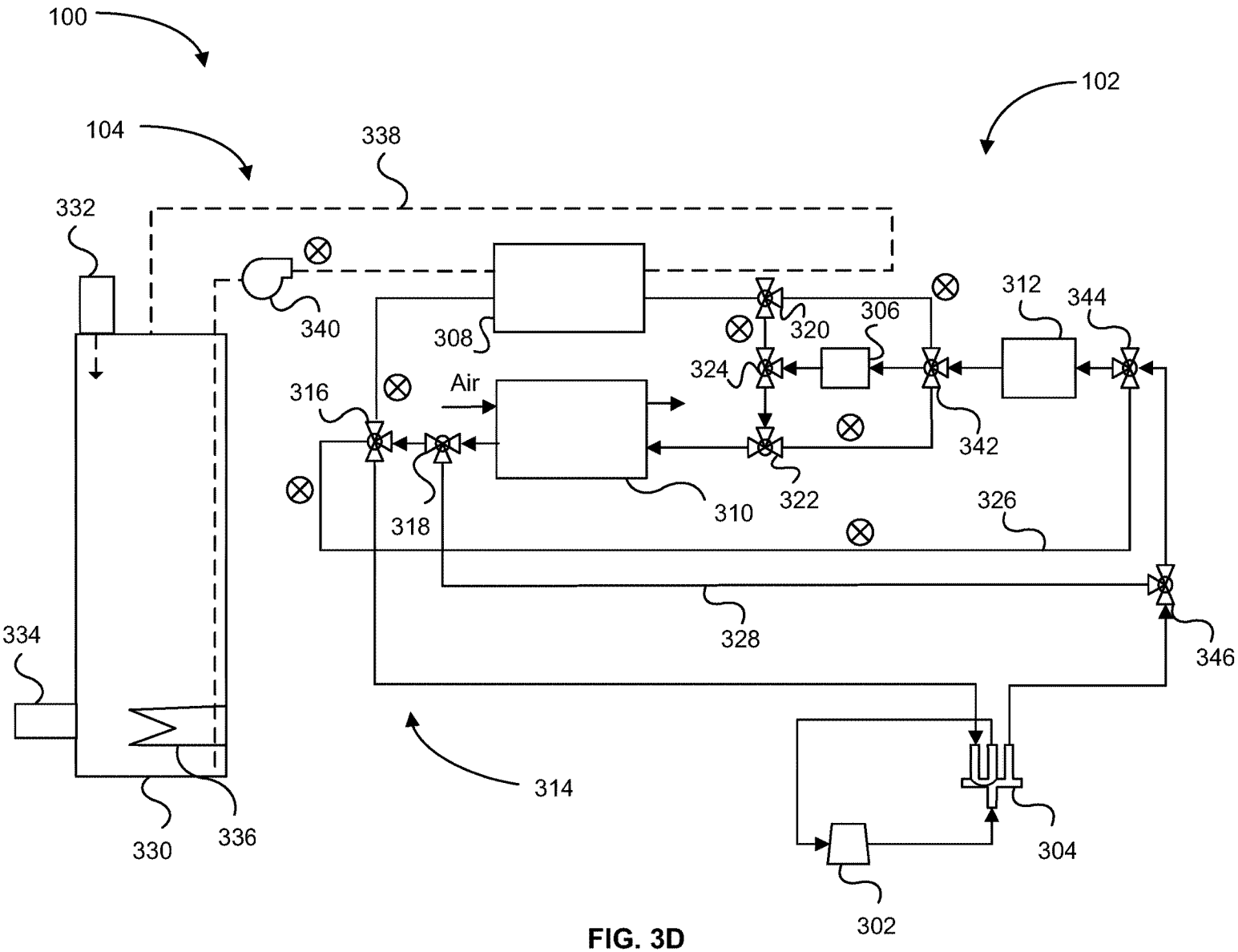
FIG. 3D is a schematic diagram of the example system of FIG. 1A configured to operate in an air-heating mode, in accordance with the disclosed technology.

FIG. 3D is a schematic diagram of the system 100 configured to operate in an air-heating mode of operation. Based on temperature data received from the indoor air temperature sensor 108 and the water temperature sensor 112 and/or the humidity date received from the indoor air humidity sensor 124, the controller 106 can determine there is a demand for air-heating and no demand for liquid-heating. In response, the controller 106 can send one or more signals to various components of the space conditioning system 102 and the liquid heating system 104 to configure the system 100 to meet the air-heating demand while operating at the target efficiency.

The controller 106 can send a signal to the water circulating pump 340 to deactivate. The controller 106 can send a signal to the reversing valve 304 to operate in the air-heating mode. The controller 106 can send signals to the plurality of valves to open and/or close in order to appropriately direct refrigerant through the refrigerant circuit 314 as described herein such that the water-cooled heat exchanger is deactivated by way of not receiving refrigerant and the outdoor heat exchanger and the indoor heat exchanger are activated by way of receiving refrigerant.

In this configuration, the water circulating pump is not activated, thereby water is not directed through the water circuit 338, and accordingly no water is pre-heated via the water-cooled heat exchanger 308. If necessary to achieve an overall target efficiency, the controller 106 can activate the heating device 336 of the liquid heating device 330 to maintain the temperature of the water at approximately the set water temperature. Alternatively, if there is a demand for heated water, the system 100 can operate in a mode as described with reference to FIG. 3F. The eighth valve 346 and the seventh valve 344 can be configured to direct high-pressure vapor refrigerant from the compressor 302 to the indoor heat exchanger 312. The eighth valve 342 can be further configured to prevent the high-pressure vapor refrigerant from being directed through the second bypass pipe 328 to the second valve 318. The seventh valve 344 can be further configured to prevent the high-pressure vapor refrigerant from being directed through the first bypass pipe 326 and to the first valve 316. As the high-pressure vapor refrigerant flows through the indoor heat exchanger 312, the indoor heat exchanger can operate as a condenser, thereby heat dissipated from the high-pressure vapor refrigerant can be absorbed by the indoor air, resulting in air-heating. The high-pressure vapor refrigerant can transition into high-pressure liquid refrigerant as the high-pressure vapor refrigerant passes through the indoor heat exchanger 312. The high-pressure liquid refrigerant can then be directed to the expansion valve 306 via the sixth valve 342. The expansion valve 306 converts the high-pressure liquid refrigerant into low-pressure liquid or two-phase refrigerant. The third valve 320 and the fifth valve 324 can be configured to direct the low-pressure liquid or two-phase refrigerant through the outdoor heat exchanger 310, which in this configuration is operating as an evaporator, thereby transitioning the low-pressure liquid or two-phase refrigerant into low-pressure vapor refrigerant. The fifth valve 324 can be configured to prevent the low-pressure liquid or two-phase refrigerant from being directed to the water-cooled heat exchanger 308 via the third valve 320. After flowing through the outdoor heat exchanger 310, the second valve 318, the first valve 316, and the reversing valve 304 can be configured to direct the low-pressure vapor refrigerant back to the compressor 302.

Figure 3E:
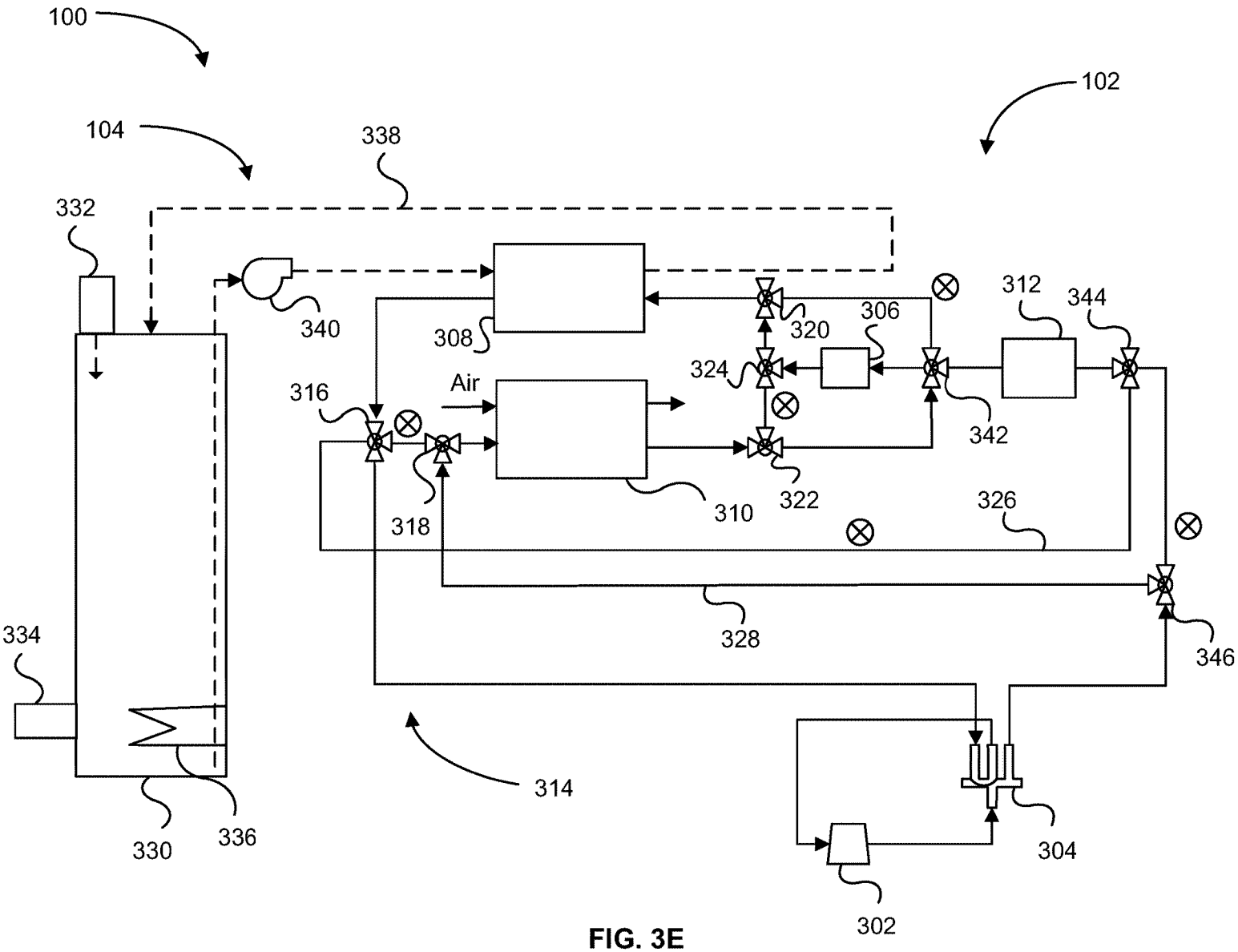
FIG. 3E is a schematic diagram of the example system of FIG. 1A configured to operate in a defrost mode, in accordance with the disclosed technology.

FIG. 3E is a schematic diagram of the system 100 configured to operate in a defrost mode of operation. Based on temperature data received from the outdoor air temperature sensor 110, the controller 106 can determine the outdoor air is cold enough to potentially cause frost to accumulate on the outdoor heat exchanger 310 when the system 100 is operating in the air-heating mode as illustrated in FIG. 3D. Optionally, the controller 106 can receive signals from the additional sensors, including the indoor air humidity sensor 124 configured to determine humidity, and in response, the controller 106 can determine there is a potential for frost to accumulate on the outdoor heat exchanger 310. Accumulation of frost can reduce efficiency of the air-cooled heat exchanger. Accordingly, the controller 106 can determine the system 100 should temporarily suspend operation of the air-heating mode and operate in a defrost mode for a predetermined time.

The controller 106 can send a signal to the water circulating pump 340 to activate. The controller 106 can send a signal to the reversing valve 304 to operate in an air conditioning mode. The controller 106 can send signals to the plurality of valves to open and/or close in order to appropriately direct refrigerant through the refrigerant circuit 314 as described herein such that the indoor heat exchanger 312 is deactivated by way of not receiving refrigerant and the outdoor heat exchanger 308 and the water-cooled heat exchanger 308 are activated by way of receiving refrigerant.

In this configuration, the space conditioning system 102 can temporarily operate in reverse as compared to the space conditioning system 102 of FIG. 3D. Accordingly, the eighth valve 346 and the second valve 318 can be configured to direct high-pressure vapor refrigerant from the compressor 302 to the outdoor heat exchanger 310, which in this configuration is operating as a condenser, via the second bypass pipe 328. The eight valve 346 can be further configured to prevent high-pressure vapor refrigerant from being directed to the indoor heat exchanger 312 via the seventh valve 344. The high-pressure vapor refrigerant can warm the outdoor heat exchanger 310 such that accumulation of frost can melt. As the high-pressure vapor refrigerant passes through the outdoor heat exchanger 310 the high-pressure vapor refrigerant can condense into high-pressure liquid refrigerant. The fourth valve 322 and the sixth valve 342 can be configured to direct the high-pressure liquid refrigerant from the outdoor heat exchanger 310 to the expansion valve 306. The expansion valve 306 can transition the high-pressure liquid refrigerant to low-pressure liquid or two-phase refrigerant. The fifth valve 324 and the third valve 320 can direct the low-pressure liquid or two-phase refrigerant to the water-cooled heat exchanger 308, which can be operating as an evaporator as water is flowing through the water circuit 228 via the water circulating pump 340. The low-pressure liquid or two-phase refrigerant can transition to low-pressure vapor refrigerant as the low-pressure liquid or two-phase refrigerant passes through the water-cooled heat exchanger 308. Because the water in the tank of the liquid heating device 330 is approximately equal to the set water temperature, the thermal energy from the water flowing through the water-cooled heat exchanger 308 can enable heat pump operation of the system 100 such that the cycle can repeat and defrosting of the outdoor heat exchanger 310 can continue for the predetermined amount of time or as determined by the controller 106 based on sensors as when to terminate the defrosting operation. By way of example, the system 100 can be configured to operate in the defrost mode for between approximately five to fifteen minutes and subsequently revert back to the air-heating mode as illustrated in FIG. 3D. Additionally, the controller 106 can monitor the temperature of water within the tank to ensure the temperature does not fall too much below the lower threshold for water temperature, thus activating the heating device 336 only when the water temperature falls below the lower threshold by a predetermined amount. Not activating 336 when the water temperature is slightly below the lower temperature threshold can result in efficient operation of the system 100. The low-pressure vapor refrigerant can then be directed from the water-cooled heat exchanger 308 back to the compressor 302 via the first valve 316.

Figure 3F:
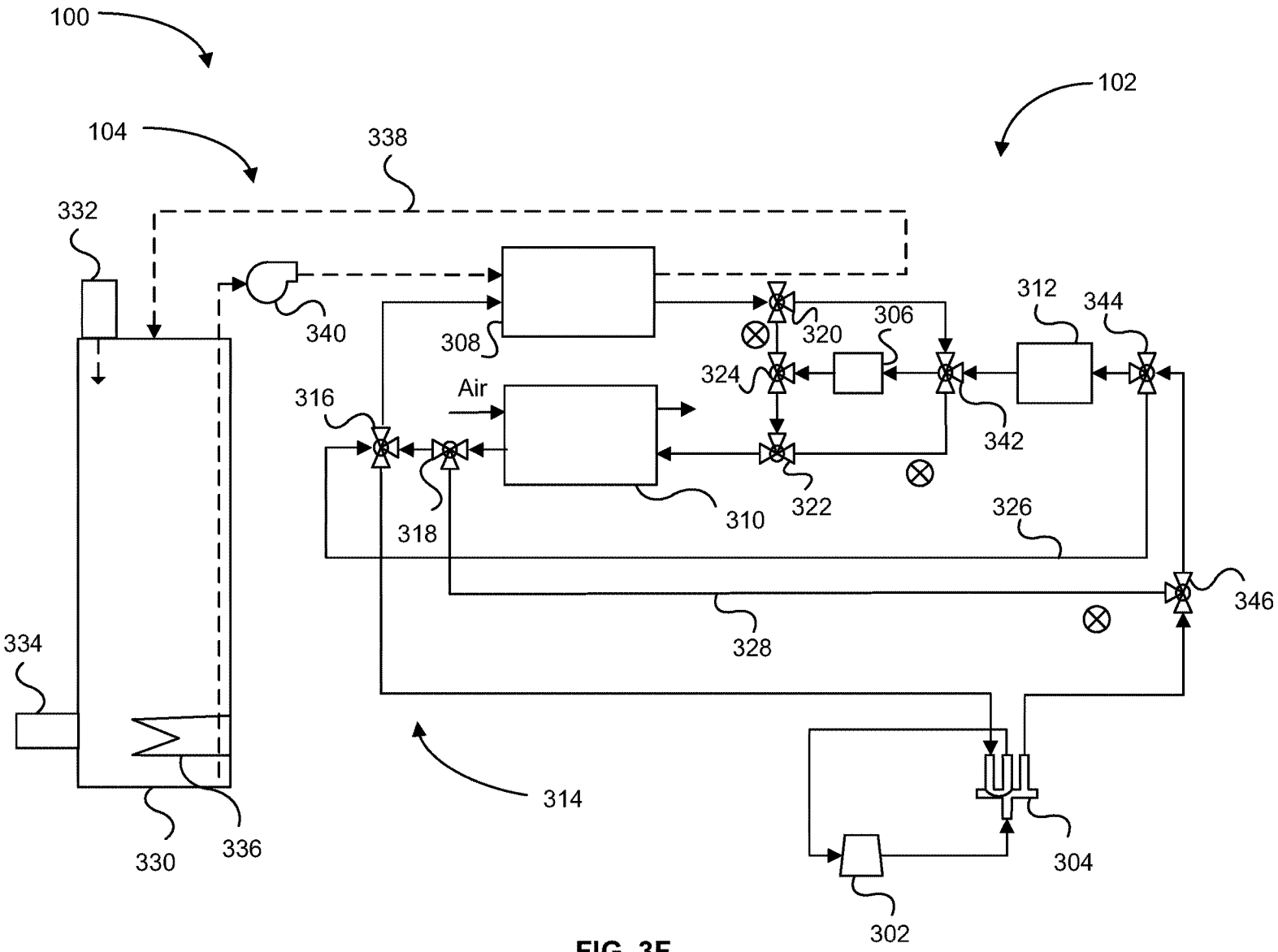
FIG. 3F is a schematic diagram of the example system of FIG. 1A configured to operate in an air-heating and a liquid-heating mode, in accordance with the disclosed technology.

FIG. 3F is a schematic diagram of the system 100 configured to operate in an air-heating and liquid-heating mode of operation. Based on temperature data received from the indoor air temperature sensor 108 and the water temperature sensor 112 and/or humidity data received from the indoor air humidity temperature 124, the controller 106 can determine there is a demand for air-heating and a demand for liquid-heating. In response, the controller 106 can send one or more signals to various components of the space conditioning system 102 and the liquid heating system 104 to configure the system 100 to meet the air-heating and liquid heating demand while operating at the target efficiency.

The controller 106 can send a signal to the water circulating pump 340 to activate. The controller 106 can further send signals to the plurality of valves to open and/or close in order to appropriately direct refrigerant through the refrigerant circuit 314 as described herein such that the water-cooled heat exchanger 308, the outdoor heat exchanger 310, and the indoor heat exchanger 312 are activated by way of receiving refrigerant. The controller 106 can send a signal to the reversing valve 304 to operate in an air-heating mode.

In this configuration, the eighth valve 346 and the seventh valve 344 can be configured to direct high-pressure vapor refrigerant from the compressor 302 to the indoor heat exchanger 312. The eighth valve 346 can be further configured to prevent the high-pressure vapor refrigerant from being directed through the second bypass pipe 328 and to the second valve 318. As the high-pressure vapor refrigerant flows through the indoor heat exchanger 312, the indoor heat exchanger 312 can function as a condenser, thereby providing air-heating as the indoor air can absorb heat dissipated from the high-pressure vapor refrigerant. As the high-pressure vapor refrigerant passes through the indoor heat exchanger 312, the high-pressure vapor refrigerant can transition into high-pressure liquid refrigerant. Upon passing through the indoor heat exchanger 312, the sixth valve 342 can direct the high-pressure liquid refrigerant to the expansion valve 306. The expansion valve 306 can transition the high-pressure liquid refrigerant to low-pressure liquid or two-phase refrigerant. The fifth valve 324 and the fourth valve 322 can be configured to direct the low-pressure liquid or two-phase refrigerant through the outdoor heat exchanger 310. The low-pressure liquid or two-phase refrigerant can transition into low-pressure vapor refrigerant as the low-pressure liquid or two-phase refrigerant passes through the outdoor heat exchanger 310. The second valve 318, the first valve 316, and the reversing valve 304 can be configured to direct the low-pressure vapor refrigerant from the outdoor heat exchanger 310 and back to the compressor 302. Additionally, the seventh valve 344 can be configured to direct high-pressure vapor refrigerant from the compressor 302 to the first valve 316 via the first bypass pipe 326. The first valve 316 can be further configured to direct the high-pressure vapor refrigerant to the water-cooled heat exchanger 308. As vapor refrigerant is being directed through the water-cooled heat exchanger 308, water can be directed through the water circuit 338 via the water circulating pump 340. The water flowing through the water-cooled heat exchanger 308 can be cooler than the vapor refrigerant also flowing through the water-cooled heat exchanger 308. Accordingly, the thermal energy can dissipate from the high-pressure vapor refrigerant to the water, thereby providing liquid-heating. As the high-pressure vapor refrigerant passes through the water-cooled heat exchanger, the high-pressure vapor refrigerant can transition into high-pressure liquid refrigerant. After passing through the water-cooled heat exchanger 308, the third valve 320 and the sixth valve 342 can be configured to direct the high-pressure liquid refrigerant to the expansion valve 306. The expansion valve 306 can transition the high-pressure liquid refrigerant to low-pressure liquid refrigerant or two-phase refrigerant. The low-pressure liquid or two-phase refrigerant can be directed to the outdoor heat exchanger 310 via the fifth valve 324 and the fourth valve 322.

Optionally, the liquid-heating effect can be temporarily suspended in order to operate in a defrost mode as illustrated in FIG. 3D. The controller 106 can receive a signal from the outdoor air temperature sensor 110 indicating an outdoor air temperature capable of producing frost on the outdoor heat exchanger 310. To prevent accumulation of frost, the controller 106 can operate the defrost mode of FIG. 3D for a predetermined amount of time. Upon completion of the defrost mode, the system 100 can revert back to the air-heating and liquid-heating mode of operation.

Additionally, in a system 100 that includes a compressor 302 configured to operate at variable speeds, the central computation unit 108 of the controller 106 can output instructions to the compressor 302 to operate at a higher speed or at a sufficient capacity that can fulfill the thermal energy need of the indoor heat exchanger 312 and the water-cooled heat exchanger 308. Alternatively, in a system 100 that includes a compressor 302 configured to operate at a single speed, the central computation unit 108 of the controller 106 can output instructions to the plurality of valves such that the demand of the indoor heat exchanger 312 is satisfied first and the demand of the water-cooled heat exchanger 308 is satisfied second. Alternatively, the central computation unit 108 of the controller 106 can output instructions to the plurality of valves such that the demand of the water-cooled heat exchanger 308 is satisfied first and the demand of the indoor heat exchanger 312 is satisfied second. The operation of the compressor 302 and prioritization of which heat exchanger will receive high-pressure vapor refrigerant first can be based on maximizing the overall efficiency of the system 100, a priority set by the user, and/or artificial learning of the AI module.

Figure 3G:
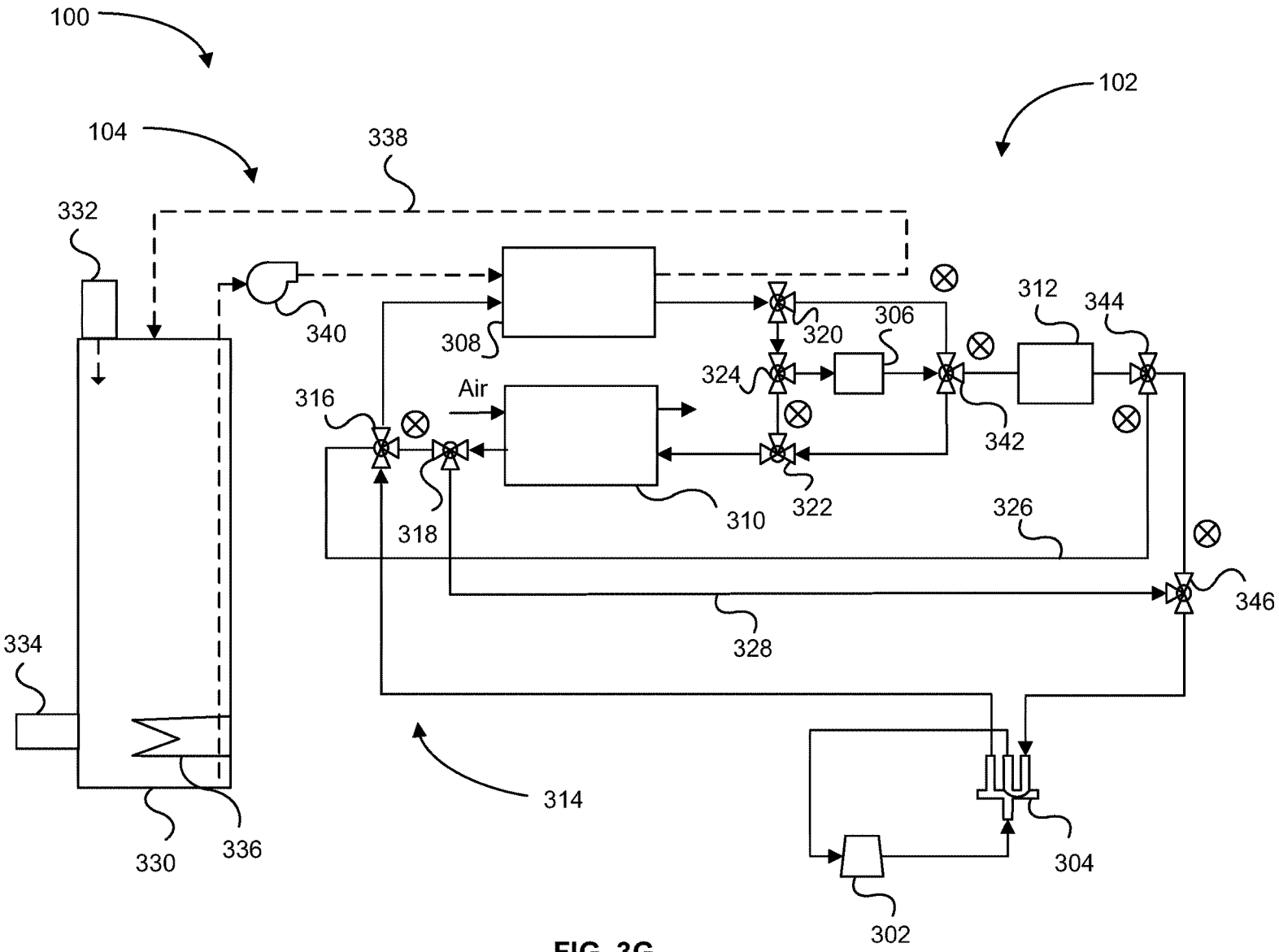
FIG. 3G is a schematic diagram of the example system of FIG. 1A configured to operate in a liquid-heating mode, in accordance with the disclosed technology.

FIG. 3G is a schematic diagram of the system 100 configured to operate in a liquid-heating mode of operation. Based on temperature data received from the indoor air temperature sensor 108 and the water temperature sensor 112 and/or humidity data received from the indoor air humidity sensor 124, the controller 106 can determine there is no demand for air-cooling or air-heating and there is a demand for liquid-heating. In response, the controller 106 can send one or more signals to various components of the space conditioning system 102 and the liquid heating system 104 to configure the system 100 to meet the liquid-heating demand while operating at the target efficiency.

The controller 106 can send a signal to the water circulating pump 340 to activate. The controller 106 can send a signal to the reversing valve 304 to operate in an air-cooling mode. The controller 106 can send one or more signals to the plurality of valves to open and/or close to appropriately direct refrigerant through the refrigerant circuit 314 as described herein such that the indoor heat exchanger 312 is deactivated by way of not receiving refrigerant and the outdoor heat exchanger 310 and the water-cooled heat exchanger 308 are activated by way of receiving refrigerant.

In this configuration, the first valve 316 can be configured to direct high-pressure vapor refrigerant from the compressor 302 to the water-cooled heat exchanger 308, which in this configuration is operating as a condenser, thereby condensing the high-pressure vapor refrigerant into high-pressure liquid refrigerant. The first valve 316 can further be configured to prevent the high-pressure vapor refrigerant from being directed to the outdoor heat exchanger 310. Simultaneously, water can be directed through the water-cooled heat exchanger 308 via the water circulating pump 340. The vapor refrigerant can be warmer than the water flowing through the water-cooled heat exchanger 308. Accordingly, the water can absorb heat from the high-pressure vapor refrigerant, thereby heating the water flowing through the water circuit 338. Optionally, the controller 106 can determine the heating device 336 can be activated to provide supplemental liquid-heating such that the system 100 operates at the target efficiency. By way of example, the controller 106 can activate the heating device 336 to provide supplement liquid-heating when the temperature of water in the tank of the liquid heating device 330 is significantly lower than the set water temperature. The third valve 320 and the fifth valve 324 can be configured to direct the high-pressure liquid refrigerant from the water-cooled heat exchanger to the expansion valve 306. The expansion valve 306 can transition the high-pressure liquid refrigerant to low-pressure liquid or two-phase refrigerant. The sixth valve 342 and the fourth valve 322 can be configured to direct the low-pressure liquid or two-phase refrigerant from the expansion valve 306 to the outdoor heat exchanger 310, which in this configuration is operating as an evaporator. The low-pressure liquid or two-phase refrigerant can transition into low-pressure vapor refrigerant as it passes through the outdoor heat exchanger 310. The sixth valve 342 can further be configured to prevent the low-pressure liquid or two-phase refrigerant from passing through the indoor heat exchanger 312. Upon passing through the outdoor heat exchanger 310, the second valve 318 and the eighth valve 346 can be configured to direct the low-pressure vapor refrigerant from the outdoor heat exchanger 310 back to the compressor 302 via the second bypass pipe 328 such that the cycle can repeat.

Certain examples and implementations of the disclosed technology are described above with reference to block and flow diagrams according to examples of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams do not necessarily need to be performed in the order presented, can be repeated, or do not necessarily need to be performed at all, according to some examples or implementations of the disclosed technology. It is also to be understood that the mention of one or more method steps does not preclude the presence of additional method steps or intervening method steps between those steps expressly identified. Additionally, method steps from one process flow diagram or block diagram can be combined with method steps from another process diagram or block diagram. These combinations and/or modifications are contemplated herein.

What is claimed is:

1. A system for conditioning air and heating liquid, the system comprising: a space conditioning system comprising a refrigerant circuit fluidly connecting a compressor, a first heat exchanger, a second heat exchanger, a third heat exchanger, an expansion valve, and a reversing valve, the refrigerant circuit comprising a conduit and a plurality of control valves configured to direct refrigerant along the refrigerant circuit; a liquid heating system comprising: a liquid heating device; and a liquid circuit fluidly connecting the liquid heating device and the first heat exchanger, the liquid circuit (i) comprising a conduit configured to direct liquid along the liquid circuit and (ii) being fluidly separate from the refrigerant circuit; and a controller in electrical communication with the space conditioning system and the liquid heating system, the controller configured to: determine a demand of the space conditioning system; determine a demand of the liquid heating system; and in response to determining the demand of the space conditioning system and the demand of the liquid heating system, output instructions to the plurality of control valves to direct the refrigerant through the refrigerant circuit and direct the liquid through the liquid circuit to simultaneously condition air and heat the liquid.

2. The system of claim 1 further comprising:

a liquid temperature sensor configured to determine data indicative of a temperature of liquid within the liquid heating device;

an indoor air temperature sensor configured to determine data indicative of a temperature of indoor air;

an indoor air humidity sensor configured to determine data indicative of a humidity of indoor air; and an outdoor air temperature sensor configured to determine data indicative of a temperature of outdoor air.

3. The system of claim 1, wherein the liquid circuit further comprises a liquid pump in electrical communication with the controller and configured to activate and deactivate to selectively direct the liquid through the liquid circuit.

4. The system of claim 1, wherein the liquid heating device comprises a tank including a supplemental heating device, the supplemental heating device being in electrical communication with the controller and configured to selectively activate and deactivate.

5. The system of claim 1, wherein the liquid heating device is a tankless water heater.

6. The system of claim 1, wherein each control valve of the plurality of control valves is in electrical communication with the controller and is configured to open and close to selectively direct the refrigerant through the refrigerant circuit.

7. The system of claim 1, wherein when the system operates in an air-cooling only mode, the plurality of control valves is configured to: direct vapor refrigerant from the compressor to the second heat exchanger, the vapor refrigerant condensing into high-pressure liquid refrigerant; direct the high-pressure liquid refrigerant from the second heat exchanger to the expansion valve such that the high-pressure liquid refrigerant transitions into low-pressure liquid refrigerant; and direct the low-pressure liquid refrigerant from the expansion valve to the third heat exchanger.

8. The system of claim 1, wherein the system operates in an air-cooling and liquid pre-heating mode, the plurality of control valves is configured to: direct vapor refrigerant from the compressor to the first heat exchanger to pre-heat the liquid flowing through the first heat exchanger, the vapor refrigerant condensing into high-pressure liquid refrigerant; direct the high-pressure liquid refrigerant from the first heat exchanger to the expansion valve such that the high-pressure liquid refrigerant transitions into low-pressure liquid refrigerant; and direct the low-pressure liquid refrigerant from the expansion valve to the third heat exchanger.

9. The system of claim 1, wherein when the system operates in an air-heating only mode, the plurality of control valves is configured to: direct vapor refrigerant from the compressor to the third heat exchanger, the vapor refrigerant condensing into high-pressure liquid refrigerant; direct the high-pressure liquid refrigerant from the third heat exchanger to the expansion valve such that the high-pressure liquid refrigerant transitions to low-pressure liquid refrigerant; and direct the low-pressure liquid refrigerant from the expansion valve to the second heat exchanger.

10. The system of claim 1, wherein when the system operates in a liquid-heating only mode, the plurality of control valves is configured to: direct vapor refrigerant from the compressor to the first heat exchanger, the vapor refrigerant condensing into high-pressure liquid refrigerant; direct the high-pressure liquid refrigerant from the first heat exchanger to the expansion valve such that the high-pressure liquid refrigerant transitions to low-pressure liquid refrigerant; and direct the low-pressure liquid refrigerant from the expansion valve to the second heat exchanger.

11. The system of claim 1, wherein when the system operates in an air-cooling and liquid-heating mode, the plurality of control valves is configured to: direct vapor refrigerant from the compressor to the first heat exchanger, the vapor refrigerant condensing into high-pressure liquid refrigerant; direct the high-pressure liquid refrigerant from the first heat exchanger to the expansion valve such that the high-pressure liquid refrigerant transitions to low-pressure liquid refrigerant; and direct the low-pressure liquid refrigerant from the expansion valve to the third heat exchanger.

12. The system of claim 11, wherein the controller is further configured to: activate a supplemental heating device disposed in a tank of the liquid heating device; and enable at least one of the control valves of the plurality of control valves to direct the vapor refrigerant from the compressor to the second heat exchanger.

13. The system of claim 1, wherein when the system operates in an air-heating and liquid-heating mode, the plurality of control valves is configured to: direct vapor refrigerant from the compressor to the first heat exchanger and the third heat exchanger, the vapor refrigerant condensing into high-pressure liquid refrigerant; direct the high-pressure liquid refrigerant from the first heat exchanger and the third heat exchanger to the expansion valve such that the high-pressure liquid refrigerant transitions to low-pressure liquid refrigerant; and direct the low-pressure liquid refrigerant from the expansion valve to the second heat exchanger.

14. The system of claim 1, wherein when the system operates in a defrost mode, the plurality of control valves is configured to: direct vapor refrigerant from the compressor to the second heat exchanger, the vapor refrigerant condensing into high-pressure liquid refrigerant; direct the high-pressure liquid refrigerant from the second heat exchanger to the expansion valve such that the high-pressure liquid refrigerant transitions to low-pressure liquid refrigerant; and direct the low-pressure liquid refrigerant from the expansion valve to the first heat exchanger.

15. A non-transitory, computer readable medium storing instructions that, when executed by one or more processors, cause a controller of an integrated system including a space conditioning subsystem and a liquid-heating subsystem to: receive, from an indoor air temperature sensor, indoor air temperature data indicative of a first temperature of indoor air; compare the indoor air temperature data to a threshold temperature of indoor air; based on the comparison of the indoor air temperature data to the threshold temperature of indoor air, determine a first demand of the space conditioning system; receive, from a water temperature sensor, water temperature data indicative of a first temperature of water; compare the water temperature data to a threshold temperature of water; based on the comparison of the water temperature data to the threshold temperature of water, determine a first demand of the liquid heating system; based at least in part on the first demand of the space conditioning system and the first demand of the liquid heating system, determine a first mode of operation of the integrated system; and in response to determining the first mode of operation, output instructions to a plurality of control valves to direct refrigerant through the space conditioning system via a network of control valves or direct liquid through the liquid heating system via a liquid pump to simultaneously condition air and heat the liquid.

16. The non-transitory, computer readable medium of claim 15, wherein determining the first mode of operation of the integrated system comprises determining an estimated time to meet the first demand of the space conditioning system and the first demand of the liquid heating system.

17. The non-transitory, computer readable medium of claim 15, wherein the threshold temperature of indoor air is defined by a user.

18. The non-transitory, computer readable medium of claim 15, wherein the threshold temperature of water is defined by a user.

19. The non-transitory, computer readable medium of claim 15, wherein directing refrigerant through the space conditioning system includes opening and closing one or more control valves of the network of control valves and directing liquid through the liquid heating system includes activating and deactivating the liquid pump such that the integrated system operates at a target efficiency.

20. The non-transitory, computer readable medium of claim 15, wherein: the instructions, when executed by the one or more processors, further cause the controller to: receive, from the indoor air temperature sensor, indoor air temperature data indicative of a second temperature of indoor air; compare the indoor air temperature data to the threshold temperature of indoor air; based on the comparison of the indoor air temperature data to the threshold temperature of indoor air, determine a second demand of the space conditioning system; receive, from the water temperature sensor, water temperature data indicative of a second temperature of water; compare the water temperature data to the threshold temperature of water; based on the comparison of the water temperature data to the threshold temperature of water, determine a second demand of the liquid heating system; based at least in part on the first demand of the space conditioning system and the first demand of the liquid heating system, determine a second mode of operation of the integrated system; transition the integrated system from the first mode of operation to the second mode of operation; and output instructions to the plurality of control valves to direct refrigerant through the space conditioning system via the network of control valves and/or direct liquid through the liquid heating system via the liquid pump.

* * * * *